United States Patent [19]

Copland et al.

[11] Patent Number: 4,673,890

[45] Date of Patent: Jun. 16, 1987

[54] WELL BORE MEASUREMENT TOOL

[75] Inventors: George V. Copland; Burchus Q. Barrington, both of Duncan, Okla.

[73] Assignee: Halliburton Company, Duncan, Okla.

[21] Appl. No.: 876,527

[22] Filed: Jun. 18, 1986

[51] Int. Cl.[4] ..... E21B 47/08; G01B 3/34

[52] U.S. Cl. ..... 33/178 F; 33/178 E; 73/783; 166/64

[58] Field of Search ..... 33/178 F, 178 E; 166/191, 64, 119, 120, 212; 181/162; 73/783, 784

[56] References Cited

U.S. PATENT DOCUMENTS

| | | | |
|---|---|---|---|
| Re. 29,471 | 11/1977 | Giroux | 166/334 |
| 2,102,080 | 12/1937 | Kinley | 33/174 |
| 2,235,533 | 3/1941 | Roberts | 33/178 |
| 2,281,960 | 5/1942 | Vacquier | 73/51 |
| 2,680,913 | 6/1954 | Johnston et al. | 33/178 |
| 2,760,580 | 8/1956 | Johnston | 166/120 |
| 2,815,578 | 12/1957 | Broussard | 33/178 |
| 2,979,134 | 4/1961 | Reed et al. | 166/187 |
| 3,023,507 | 3/1962 | Camp | 33/178 |
| 3,165,919 | 1/1965 | Loomis | 73/40.5 |
| 3,173,290 | 3/1965 | Conover | 73/40.5 |
| 3,436,836 | 4/1969 | Metevia | 33/178 |
| 3,474,541 | 10/1969 | Cubberly, Jr. | 33/178 |
| 3,488,856 | 1/1970 | Wiklund | 33/178 |
| 3,664,415 | 5/1972 | Wray et al. | 166/0.5 |
| 3,690,166 | 9/1972 | Grice | 73/152 |
| 3,850,250 | 11/1974 | Holden et al. | 166/315 |
| 3,857,449 | 12/1974 | Khuura | 175/26 |
| 3,898,741 | 8/1975 | Casey | 33/178 F |
| 3,970,147 | 7/1976 | Jessup et al. | 166/250 |
| 4,063,593 | 12/1977 | Jessup | 166/317 |
| 4,064,937 | 12/1977 | Barrington | 166/162 |
| 4,109,724 | 8/1978 | Barrington | 166/315 |
| 4,230,180 | 10/1980 | Patton et al. | 166/185 |
| 4,251,921 | 2/1981 | Fink | 33/178 F |
| 4,270,610 | 6/1981 | Barrington | 166/317 |
| 4,281,715 | 8/1981 | Farley | 166/317 |
| 4,319,633 | 3/1982 | McMahan et al. | 166/250 |
| 4,443,948 | 4/1984 | Reeves | 33/178 E |
| 4,500,156 | 2/1985 | Nguyen | 339/94 C |
| 4,510,797 | 4/1985 | Guidry et al. | 73/151 |
| 4,540,941 | 9/1985 | Walkow | 33/178 F |
| 4,541,481 | 9/1985 | Lancaster | 166/65.1 |
| 4,559,709 | 12/1985 | Beseme et al. | 33/178 |
| 4,566,535 | 1/1986 | Sanford | 166/113 |

FOREIGN PATENT DOCUMENTS 2157003 3/1985 United Kingdom .

*Primary Examiner*—Charles T. Jordan
*Assistant Examiner*—John W. Eldred
*Attorney, Agent, or Firm*—Joseph A. Walkowski

[57] ABSTRACT

A caliper is mounted on two springs in a free-floating manner between interlockable upper and lower packers to be set in a well bore. The caliper has radially extendible arms which are extendible in response to independent forces exerted thereon as derived from the movement of a carriage driven by a single motor contained in the caliper tool. A clutch mechanism is used to lock the arms to precision measurement transducers only after the arms have been moved radially outwardly a sufficient distance. Other transducers for generating signals indicating the total movement of the arms and for indicating the forces exerted by the springs on the arms are included in the preferred embodiment.

28 Claims, 17 Drawing Figures

WELL BORE MEASUREMENT TOOL

BACKGROUND OF THE INVENTION

This invention relates generally to well bore measurement tools and more particularly, but not by way of limitation, to a fracture orientation caliper tool mounted between two interlockable packers.

In fracturing a formation intersected by a well bore, it is known that two seals, referred to as packers, are set in the well at the upper and lower boundaries of the formation to be fractured. A pressurized fracturing fluid is then injected between the set packers through a tubing or pipe string on which the packers are carried into the hole. Such procedure can be used either when the well bore is lined with a casing or when the well bore is unlined (referred to herein as an open well bore, or the like). It is important that once the packers are set, they remain set (until specifically released) so that the fracturing fluid will be properly contained to achieve the desired fracturing and so that hazardous conditions are not thereby created. It is also important for the packers to remain set when a measuring tool, such as a precision caliper tool subassembly, is carried between them. Any movement of the packers that is communicated to a tool such as a caliper could produce false readings and seriously damage such a tool when it has its measurement arms extended.

When the well bore is lined with a casing or the like, known types of mechanical and hydraulic slips can be used to engage the casing so that upward movement of the top packer, such as in response to the pressure of the fracturing fluid exceeding the hydrostatic pressure existing above the top packer, is prevented. Preventing such upward movement can also sometimes be accomplished to some degree by "slacking off" the tubing or pipe string so that the weight of the string exerts a downward acting force on the packers.

When packers are to be set in open well bores, however, the aforementioned mechanical and hydraulic slips have not been helpful in anchoring the top packer against upward movement. Likewise, the use of "slacked-off" tubing has been inadequate in general because in deep wells where the slacked-off pipe weight would be sufficient to prevent upward movement, the weight has been known to create a force exceeding the loading characteristic of the packer, thereby damaging it. In shallower wells, the upward applied force exerted by the fracturing fluid can easily overcome the lesser pipe weight, thereby causing the top packer to become unseated.

The foregoing problem particularly pertains to upward movement of the top packer because the lower packer has the greater fracturing fluid pressure acting downwardly on it, and its downward movement is limited by an anchor pipe testing on the bottom of the hole or engaging the side wall of the bore. The interconnecting construction of conventional dual packers known to the art is such that this downward limitation is also applicable to the top packer so that it is only the upward movement of the upper packer which is of primary concern.

Although one can circumvent this problem by always casing or lining the well bore and by then using the known types of casing engaging locks, it is desirable to solve the problem in a manner whereby open hole packers can be securely set and locked in open well bores because this saves the time and expense of always having to case or line the well bore while still accomplishing reliable fracturing.

The foregoing exemplifies the particular need for a lock by which a top or upper packer can be locked relative to a bottom or lower packer to prevent upward movement of the upper packer in response to the fracturing fluid pressure exerted between the two packers when the packers are used in an open well bore. The satisfaction of this need, however, would also provide an improved lock useful in other types of downhole apparatus which require locking against relative movement between different parts of the apparatus.

There is also the need for a device which can be used with the interlockable packers to determine the direction of a fracture that is created by a hydraulic fracturing process or treatment which is applied between the interlocked packers. This determination can be made with an instrument which measures the deformation of the well bore during the hydraulic pressurization of a fluid contained between the two packers set in the well bore. Such an instrument is referred to as a caliper, of which there are various types known to the art, but for which there is the need for an improved type having several features.

One of the desired features is a construction by which, after being run into the well bore beween the two packers, the caliper can be locked into the formation by its own force applied through a single set of implements which securely fasten the caliper to the formation and which also provide movements sensitive to the deformation of the formation. The mounting of this device between the packers should be in such a manner that if either or both of the packers moves relative to the formation, such movement does not affect the operation of the caliper.

The forces which are to be applied through the single set of implements are preferably generated by a single drive unit to simplify the construction and maintenance of the caliper. Such single drive unit preferably, however, is capable of applying independent forces to the individual holding implements to accommodate the various dispositions of the caliper in the well bore, which has a side wall that will never be perfectly round and thus never evenly spaced from the caliper. Such single drive unit must be capable of creating forces great enough to securely fix the caliper to the formation.

To further maintain simplicity of design, the implements used to secure the caliper to the formation should be the same ones to detect deflections of the formation caused by the fracturing process. Such detections should be highly sensitive so that accurate in situ stress measurements, which are fundamental to understanding rock fracture mechanics, can be obtained. In addition to the taking of such highly sensitive measurements, however, the tool should also be capable of making relatively large measurements from which the total radial movement of the arms can be measured to determine diameters or transverse dimensions of the hole in which the tool is used.

Such an improved caliper tool should also be capable of measuring the forces applied to the formation engaging implements so that other properties of the formation can be determined. For example, rock hardness can be determined knowing the forces applied to the formation through the implements and the distances the implements have moved.

Despite having such a novel combination of features as just described, the tool should also be able to maintain features found in existing tools, such as means for measuring pressure, temperature and orientation.

SUMMARY OF THE INVENTION

The present invention overcomes the above-noted and other shortcomings of the prior art and satisfies the aforementioned needs by providing a novel and improved well bore measurement tool. The present invention has particular utility in a double packer used in an open well bore. That is, with the present invention the upper packer of the double or dual packer assembly can be controllably locked and unlocked against upward movement which would otherwise occur in response to a pressure, applied through the tubing between the two packers, exceeding the hydrostatic pressure and the weight of the pipe or tubing acting downwardly on the upper packer. It is contemplated that the present invention could, however, have broader applications with respect to, in general, a downhole apparatus having an inner tubular member and an outer tubular member in which the inner tubular member is slidably disposed.

The present invention also provides a caliper which is combined with the interlockable dual packers to form the overall well bore measurement tool of a particular embodiment of the present invention. The caliper design for the present invention is such that the caliper is run into the well bore mounted in a free-floating manner between the interlockable packers. The caliper utilizes a single drive unit capable of extending and retracting formation engagement arms which hold the caliper to the formation with independently exerted forces and which detect deflections of the formation in response to the pressurized fracturing fluid applied between the interlocked packers. The caliper is highly sensitive in detecting such deflections; however, it is also capable of taking larger measurements which reflect total diameters or transverse dimensions of the well bore. In a particular embodiment, the caliper can detect forces applied to the arms so that other properties, such as rock hardness, can be derived. This particular embodiment also incorporates other detecting devices for detecting such phenomena as pressure, temperature and orientation.

The overall well bore measurement tool of the present invention incorporating both the interlockable packers and the caliper broadly comprises lower packer means for providing a lower seal in the well bore, upper packer means for providing an upper seal in the well bore, caliper means for measuring a deflection of the side wall of the well bore, and retainer means for retaining the caliper means between the lower and upper packer means so that the caliper means is transportable into the well bore with the lower and upper packer means but so that the lower and upper packer means are longitudinally movable relative to the caliper means when the caliper means engages the side wall of the well bore. This tool further comprises lock means for locking the upper packer means to the lower packer means.

The caliper means comprises a support member; a pivot arm pivotally connected to the support member; sensor means for sensing a movement of the pivot arm when the sensor means is coupled to the pivot arm, which sensor means includes displacement measurement means, connected to the support member, for generating a signal in response to a sensed movement of the pivot arm, and connecting means for releasably connecting the pivot arm to the displacement measurement means; and actuating means, connected to the support member, for actuating the connecting means to connect the pivot arm to the displacement measurement means. In a particular embodiment the caliper includes a plurality of pivot arms, each of which includes two sections having a common pivoted connection and having their opposite ends pivotally connected to the support member and to a drive means, respectively. The drive means commonly moves the pivot arms so that each common pivoted connection is simultaneously moved outwardly from the housing, and the drive means exerts independent forces on the pivot arms. Each pivot arm moves independently of the others, thus providing a precise measurement, via the displacement measurement means, of the well bore shape.

Therefore, from the foregoing, it is a general object of the present invention to provide a novel and improved well bore measurement tool. Other and further objects, features and advantages of the present invention will be readily apparent to those skilled in the art when the following description of the preferred embodiments is read in conjunction with the accompanying drawings.

DETAILED DESCRIPTION OF THE PREFERRED EMBODIMENTS

The preferred embodiment of the present invention will be described with reference to a dual packer assembly 2 disposed in an open well bore 4. This particular construction is schematically illustrated in FIG. 1 (although not so illustrated because of the schematic nature of FIG. 1, the bore 4 has an irregular side wall, not a smooth side wall, as known to the art).

Figure 1:
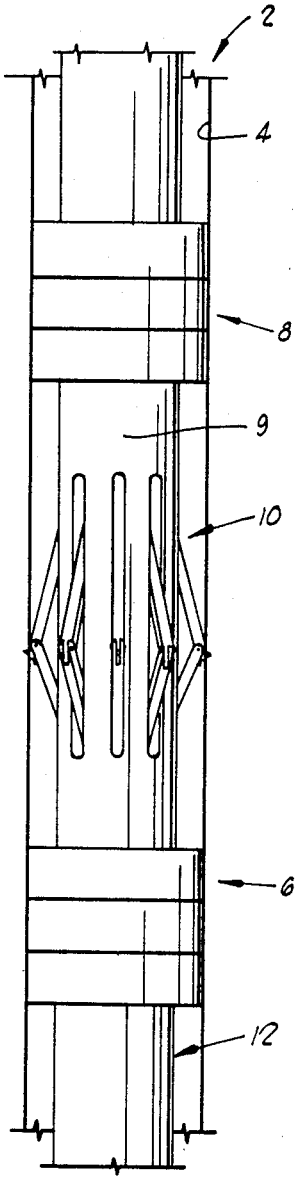
FIG. 1 is a schematic illustration of a double or dual packer/caliper assembly depicting the preferred embodiment of the present invention.

The dual packer assembly 2 schematically illustrated in FIG. 1 includes a bottom or lower packer section 6 of conventional design (such as the lower end of a Halliburton Services No. 2 NR packer assembly). Spaced above the lower packer section 6 is a top or upper packer section 8 which includes at least part of a conventional upper packer assembly (such as the top portion of a Halliburton Services No. 2 NR packer assembly), but which also incorporates the novel and improved lock by which the packers can be interlocked in the present invention.

Shown mounted within a slotted sleeve 9 extending between the packer sections 6, 8 is a caliper tool 10 which is also part of the present invention. Although a caliper tool generally exemplifies a device whose proper operation can require that the top packer section 8 not be displaced when the fracturing pressure, applied to the volume of the well bore 4 which is between the packer sections and in which the caliper tool 10 is disposed, exerts a force that exceeds any downwardly acting weight of the pipe on which the packer assembly 2 and the tool 10 are lowered into the well and the force of any hydrostatic head acting downwardly on the upper packer section 8, the caliper tool 10 of the preferred embodiment is constructed and mounted so that at least some movement of the packers is tolerated. However, the use of a caliper with the packers does generally illustrate the need for the lock of the present invention by which the upper packer section 8 can be effectively locked to the lower packer section 6, which is anchored by an anchor pipe 12 into the bottom or the side of the hole 4, to prevent upward movement of the packer of the section 8. Even used alone the packers can need to be interlocked to prevent unseating the top packer, which unseating could possibly allow the fracturing fluid to escape to the surface where a hazardous situation could result. The preferred embodiment of this lock is illustrated within the downhole apparatus shown in FIGS. 2A–2F.

The downhole apparatus illustrated in FIGS. 2A–2F in conjunction with the lock of the present invention is an example of the upper packer section 8. This apparatus broadly includes an inner tubular member 14 and an outer tubular member 16, both of which include a plurality of components. The inner member 14 is slidable relative to the outer member 16, but these two members can be locked together by a lock 18 of the present invention.

Figure 2A:
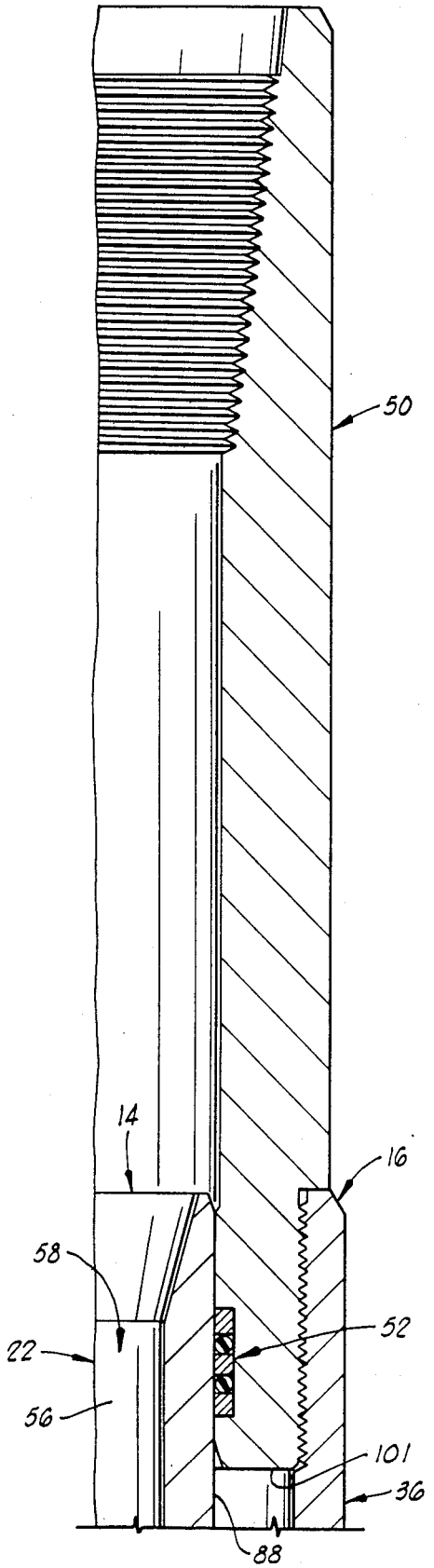
FIGS. 2A–2F form a partial sectional view of an upper packer section which can be used in the assembly illustrated in FIG. 1 and which includes the preferred embodiment of a lock by which the two packers of the FIG. 1 assembly can be interlocked.
Figure 2B:
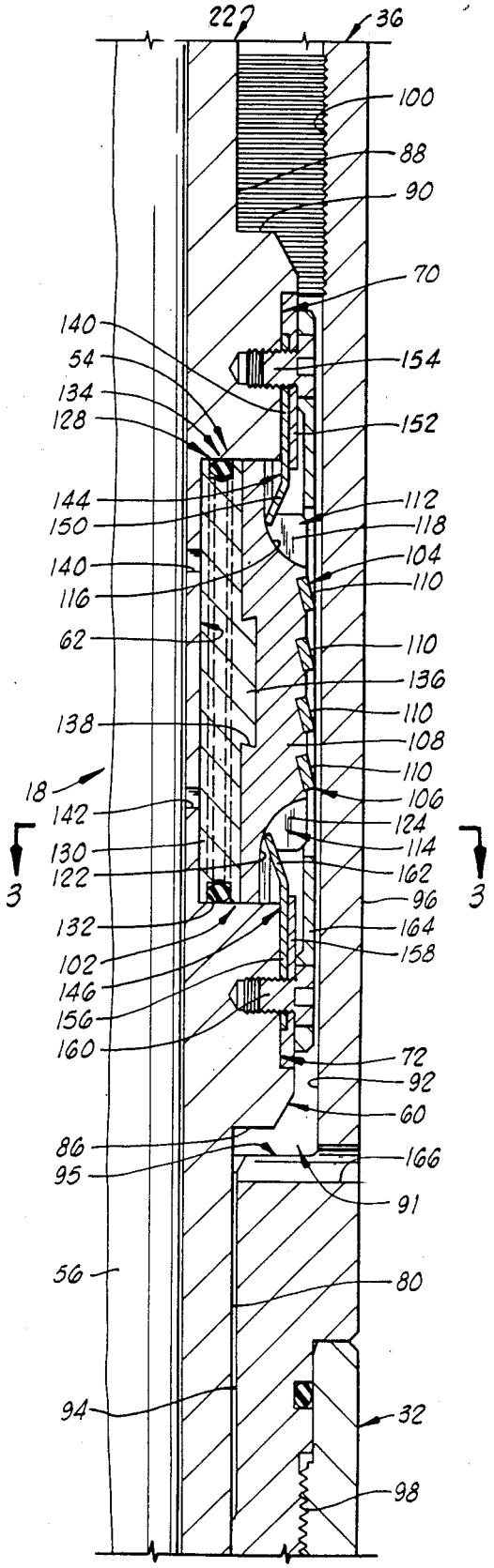
Figure 2C:
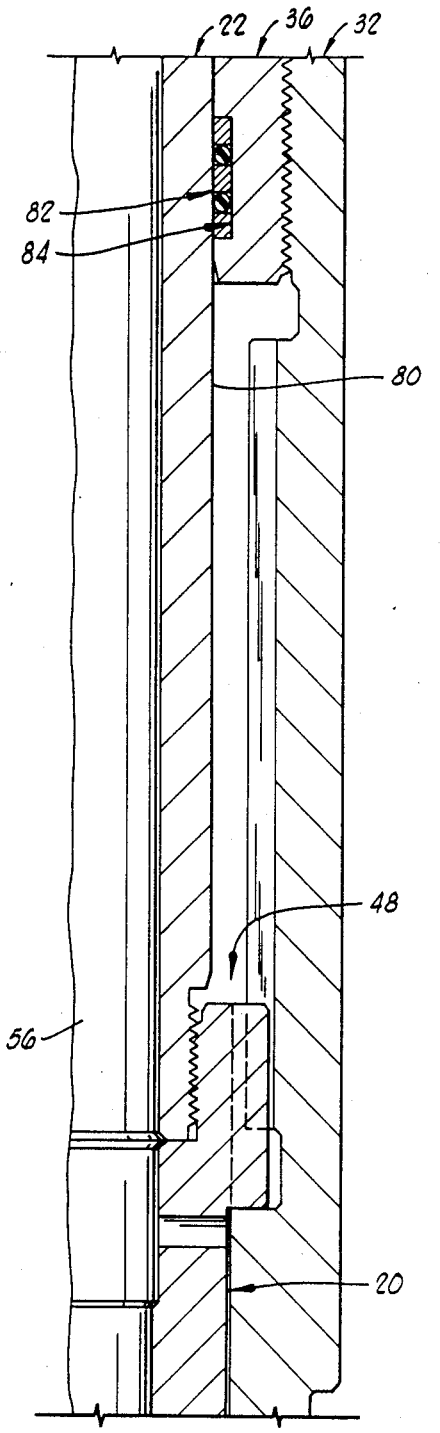

The inner tubular member 14 of the upper packer section 8 is characterized in the preferred embodiment as a mandrel assembly including a packer mandrel 20 (FIGS. 2C–2F) and a locking mandrel 22 (FIGS. 2A–2C). The packer mandrel 20 is a cylindrical tube of conventional design having a lower externally threaded end for engaging a lower adapter 24 of a conventional type used for connecting (through the caliper tool 10 in the FIG. 1 configuration) to the lower packer section 6 anchored on the bottom or in the side wall of the well bore 4 by the anchor pipe 12. The packer mandrel 20 has an internally threaded throat at its other end for threadedly coupling with an externally threaded end of the locking mandrel 22, which locking mandrel 22 forms part of the lock 18 and will be more particularly described hereinbelow.

Figure 2D:
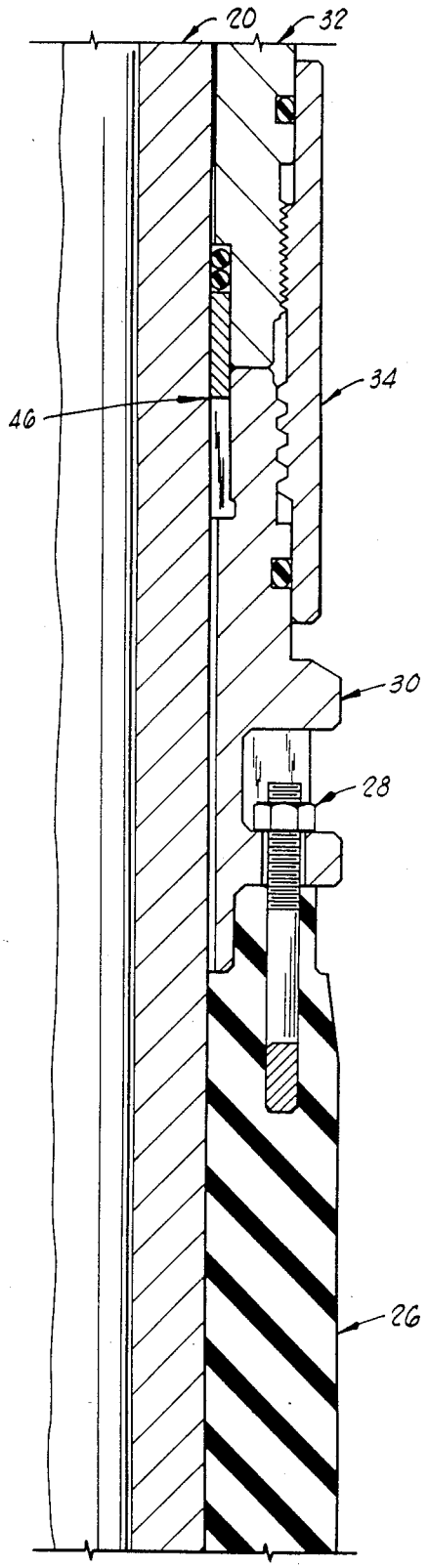

The outer tubular member 16 is characterized in the preferred embodiment as an upper packer carrying assembly having a packer 26 (FIGS. 2D–2E) connected (such as by a bolting fastening means including the nut and bolt combination 28 shown in FIG. 2D) to a packer carrier sleeve. The packer carrier sleeve includes a packer retaining collar 30, to which the packer 26 is fastened, and a connecting sleeve 32, to which the retaining collar 30 is connected by a quick change coupling 34 (FIGS. 2B–2D). The packer carrier sleeve of the outer tubular member 16 also includes a locking sleeve 36 (FIGS. 2A–2C) which is threadedly connected to the connecting sleeve 32 and which forms another part of the lock 18 to be more particularly described hereinbelow.

Figure 2E:
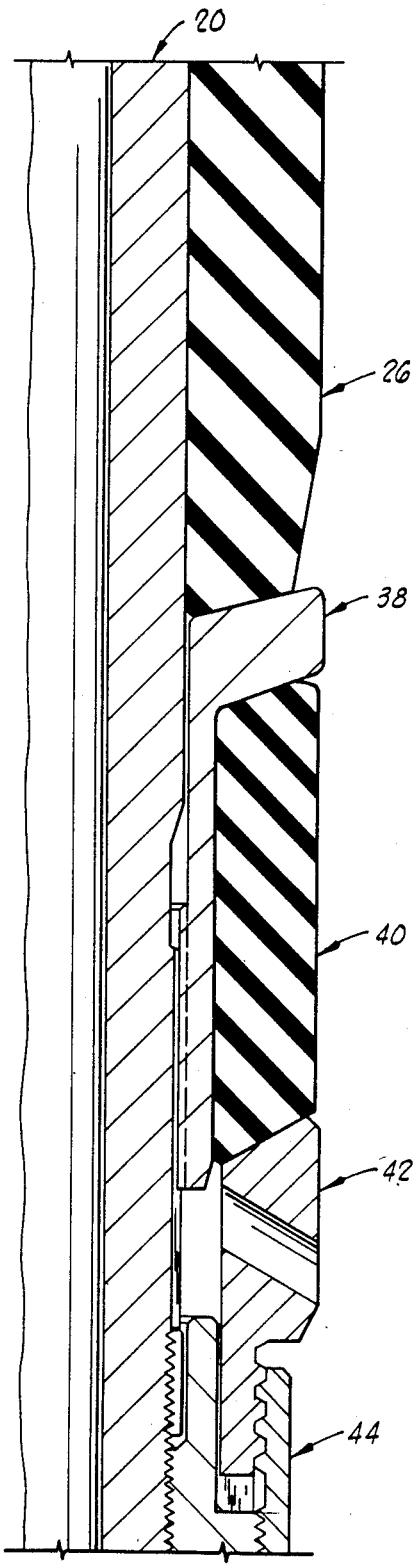
Figure 2F:
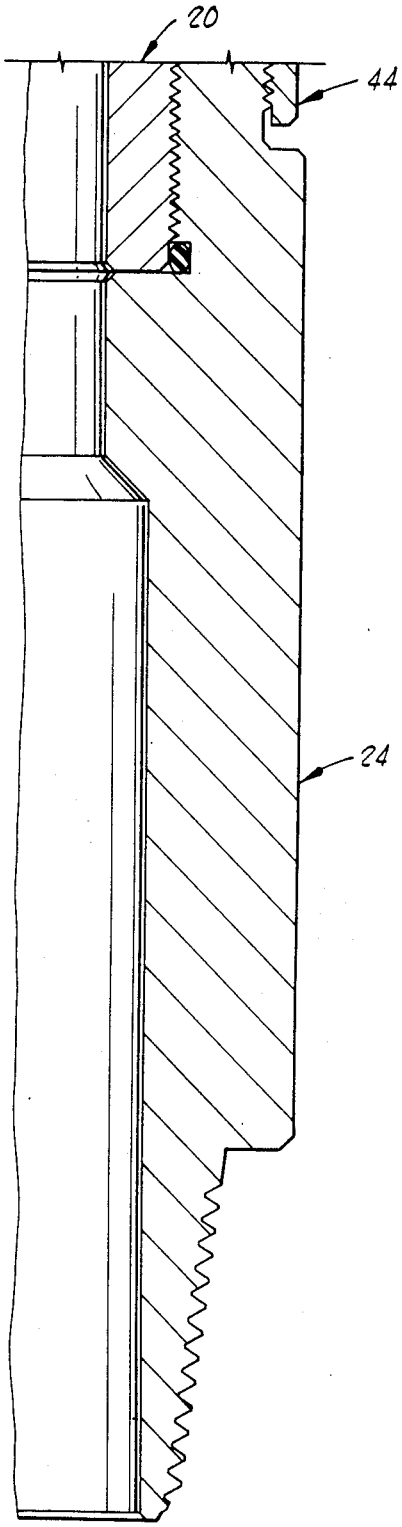

The packer 26 of the preferred embodiment is made of a composition (e.g., an elastomer) of a type as known to the art. It has an annular shape defining a hollow interior in which the packer mandrel 20 is slidably received. Providing lower support to the packer 26 are a packer support 38 (shown in FIG. 2E as being splined with the packer mandrel 20), a rubber packer shoe 40, a packer shoe support 42 and a coupling collar 44 threadedly interconnecting the shoe support 42 with the lower adapter 24 (FIGS. 2E–2F). These elements are of conventional designs known to the art and thus will not be further described.

The packer retaining collar 30, the connecting sleeve 32, and the quick change coupling 34 are also of conventional designs and will not be particularly described because these designs are known to the art. It will be noted, however, that the coupling between the packer retaining collar 30 and the connecting sleeve 32 includes a known type of seal 46 retained in between the packer retaining collar 30 and the connecting sleeve 32 and adjacent the packer mandrel 20 as shown in FIG. 2D. Additionally, the connecting sleeve 32 is shown as having a splined interconnecting relationship with the packer mandrel 20 as identified by the reference numeral 48 in FIG. 2C.

The outer tubular member 16 connects at its upper end to an upper adapter 50 (FIG. 2A) having a conventional design for connecting to the tubing or pipe string (not shown) on which the dual packer assembly 2, and the caliper tool 10 in the FIG. 1 example, are run into the open well bore 4. The upper adapter 50 carries a seal 52 for providing a sliding fluid seal between the upper adapter 50 and the locking mandrel 22.

The lock 18 includes not only the aforementioned locking mandrel 22 and the locking sleeve 36, but also a latching mechanism 54. Each of these elements will be more particularly described with primary reference to FIGS. 2A–2C, 3C, and 4.

The locking mandrel 22 is a means for connecting part of the lock 18 with the packer mandrel 20 inside the portion of the upper packer section 8 defining the outer tubular member 16. The locking mandrel 22 is an elongated member having a cylindrical inner surface 56 defining a longitudinal channel 58 extending throughout the length of the locking mandrel 22. The channel 58 of the preferred embodiment is disposed axially through the mandrel 22.

Figure 3:
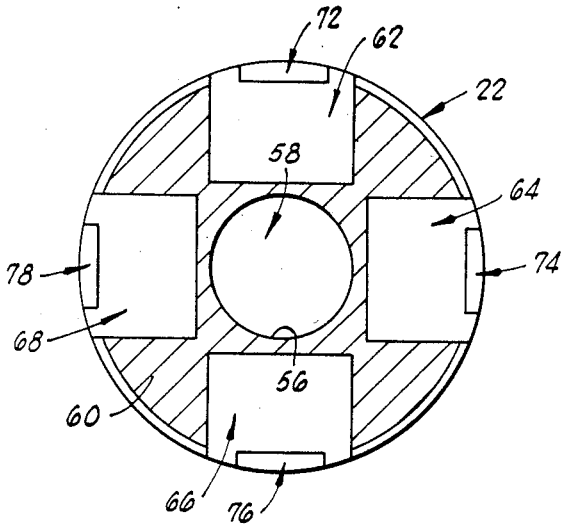
FIG. 3 is a sectional end view of a locking mandrel of the lock of the preferred embodiment as taken along line 3—3 shown in FIG. 2B, but without the other structures shown in FIG. 2B.
Figure 4:
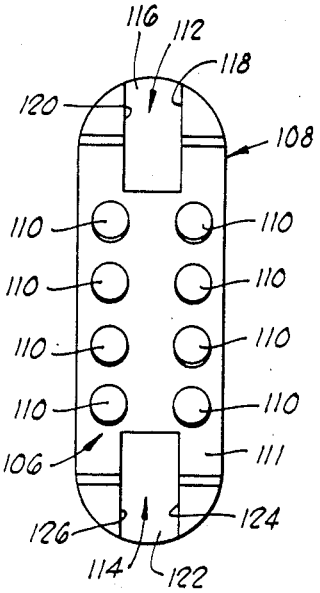
FIG. 4 is a plan view of a portion of a latch member of the lock of the preferred embodiment.

The mandrel 22 also has a cylindrical protuberant portion 60 extending radially outwardly from the main body of the mandrel 22. Milled or otherwise defined in the protuberant portion 60 are four cavities 62, 64, 66, 68 (FIGS. 2B and 3) which extend through the outer surface of the protuberant portion 60 and into the protuberant portion 60 transversely to the length of the mandrel 22. In the preferred embodiment these cavities extend radially with respective parallel side walls or surfaces extending perpendicularly from a respective bottom wall or surface. Associated with each of the four cavities are two slots extending longitudinally from opposite ends of the respective cavity. The two slots associated with the cavity 62 are identified in FIG. 2B by the reference numerals 70, 72. For the cavities 64, 66, 68, slots 74, 76, 78, respectively, corresponding to the slot 72 for the cavity 62, are shown in FIG. 3. The cavities 62, 64, 66, 68 are disposed in two pairs of diametrically opposed cavities whereby one pair includes the cavities 62, 66 and the other pair includes the cavities 64, 68. These cavities and slots open towards or face the locking sleeve 36.

The mandrel 22 also includes a cylindrical outer surface 80 defining a lower sealing surface engaged by a seal 82 (FIG. 2C) retained in a recess 84 of the locking sleeve 36. The diameter of the surface 80 is less than the outermost diameter of the protuberant portion 60 so that a radially extending annular shoulder 86 is defined therebetween.

The mandrel 22 has another cylindrical outer surface 88. The outer surface 88 extends longitudinally from the end of the protuberant portion 60 opposite the end thereof from which the surface 80 extends. The surface 88 has the same diameter as the surface 80; therefore, there is also a radially extending annular shoulder defined between the surface 88 and the outermost portion of the protuberant portion 60, which annular shoulder is identified in FIG. 2B by the reference numeral 90. The outer surface 88 defines an upper sealing surface engaged by the seal 52 carried by the upper adapter 50. The seal 52 and the seal 82 have the same size so that a hydraulically balanced seal is created between the locking mandrel 22 and the locking sleeve 36 on opposite sides of the protuberant portion 60.

The protuberant portion 60 can travel longitudinally or axially within a volume 91 defined between facing surfaces of the locking mandrel 22 and an inner surface 92 of the locking sleeve 36. This volume is also between the longitudinally spaced, circumferential seals 52, 82. This volume is defined in part by the inner surface 92 of the locking sleeve 36 being offset radially outwardly from an inner surface 94 of the locking sleeve 36. This offset is established across a radial annular shoulder 95 which faces the shoulder 86 of the locking mandrel 22. The locking sleeve 36 has a cylindrical outer surface 96 and a threaded outer cylindrical surface 98 radially inwardly offset from the surface 96 for engaging an internal thread of the connecting sleeve 32.

Defined along the inner surface 92 is a locking sleeve engagement surface 100 comprising in the preferred embodiment grooves or serrations or teeth defining engagement means for interlocking with cooperating elements of a latch member forming part of the latching mechanism 54. The locking sleeve engagement surface 100 is not coextensive with the length of the surface 92 so that the latching mechanism 54 is longitudinally movable between a longitudinally located unlatched or disengagement position, located in the preferred embodiment relatively closer to the shoulder 95 than to the opposite end of the volume adjacent a radial annular surface 101 of the upper adapter 50, and a longitudinally located latchable or engagement position, wherein at least part of the latching mechanism overlies at least a portion of the locking sleeve engagement surface 100.

The latching mechanism 54 of the preferred embodiment includes latch member means, slidably disposed in at least one of the cavities 62, 64, 66, 68, for engaging the packer carrying sleeve assembly (specifically, the locking sleeve engagement surface 100 in the preferred embodiment) when the latch member means is moved to the aforementioned longitudinal engagement position and then to a radially located latched or engagement position. The latching mechanism 54 also includes actuating pressure communicating means, disposed in the tubular member on which the latch member means is mounted, for communicating an actuating pressure to the latch member means so that the latch member means moves towards the other tubular member, and into the radial engagement position, in response to the actuating pressure. The latching mechanism 54 also includes biasing means, connected to the tubular member on which the latch member means is mounted, for exerting a biasing force against the latch member means in opposition to a force exerted on the latch member means by the actuating pressure so that the latch member means is biased away from the other tubular member and thus towards a radial disengagement position which is out of engagement with the locking sleeve engagement surface 100 even though the locking member means even partially overlies the engagement surface 100 and is thus at a longitudinal latchable or engageable position. Thus, this biasing force tends to move the latch member means deeper into its respective cavity. The latching mechanism 54 still further includes hydrostatic pressure communicating means, disposed in the tubular member on which the latch member means is not mounted, for communicating a hydrostatic pressure to the latch member means so that a force exerted by the hydrostatic pressure is applied to the latch member means in opposition to a force exerted on the latch member means by the actuating pressure.

The latch member means of the preferred embodiment includes four latch members, each disposed in a respective one of the cavities 62, 64, 66, 68. Because each of these latch members is identical, only a latch member 102 principally shown in FIG. 2B will be described. The latch member 102 includes a gripping member or means 104 for defining a latch member engagement surface 106 (see also FIG. 4) facing the inner surface 92 of the locking sleeve 36. The gripping means 104 of the preferred embodiment is constructed of an oblong carrier block 108 and a plurality of gripping teeth 110 defined in the preferred embodiment by carbide inserts retained in the carrier block 108 at oblique angles thereto to give a tilted configuration to the carbide inserts which facilitates their ability to bite or grip into the locking sleeve engagement surface 100 of the locking sleeve 36. The teeth 110 are received along a rectangular planar surface 111 of the carrier block 108, and they define a plurality of protuberances extending from the surface of the carrier block 108. Milled or otherwise defined in opposite ones of the curved ends of the oblong block 108 are respective recesses 112, 114. The recess 112 has a curved lower surface 116. Parallel planar surfaces 118, 120 extend from opposite edges of the surface 116. The recess 114 has a curved lower surface 122 and parallel planar surfaces 124, 126 extending from opposite edges of the surface 122. The latch member 102 also includes seal means 128, detachably connected to the carrier block 108, for providing a sliding seal between the latch member 108 and the inner side walls of the cavity 62 in which the latch member 102 is disposed. The seal means 128 includes a seal support member 130 having an oblong configuration similar to that of the carrier block 108 and similar to the shape of the cavity 62. A peripheral groove 132 is defined around the perimeter of the seal support member 130. The groove 132 receives a seal assembly 134 comprising an O-ring or other suitable fluid member and also comprising a seal back-up ring which reduces the friction of the movable seal and which reinforces the primary seal ring against high pressure differentials that may exist across the sealing structure.

The seal support member 130 is connected to the carrier block 108 by a suitable connector means whereby the two are releasably connected to enable the carrier block 108 to be released from the seal support member 130, such as when the latch member engagement surface defined by the gripping teeth 110 is worn out and is to be replaced with another such gripping means. In the preferred embodiment this connector means includes a dovetail tenon 136, protruding from a central portion of the seal support member 130, and a mortise 138, defined centrally along and transversely across a surface of the carrier block 108 for slidably receiving the dovetail tenon 136.

These components of the latch member 102 define a slidable body which is movable within the cavity 62. Corresponding components define a plurality of other latch members respectively disposed in the cavities 64, 66, 68 for simultaneous slidable movement with the latch member 102. These movements occur in response to an actuating pressure provided through the tubing or pipe string from the surface and into the channel 58 of the locking mandrel 22 for communication into the cavities 62, 64, 66, 68 through respective ones of the plurality of actuating pressure communicating means contained in the preferred embodiment of the present invention. Because each of these communicating means is identical in the preferred embodiment, only the one associated with the cavity 62 will be particularly described hereinbelow.

In the preferred embodiment the actuating pressure communication means communicates a hydraulic pressure from the axial channel 58 into the cavities 62, 64, 66, 68 of the locking mandrel 22. This pressure exerts a force against the latch member 102 and the other similar latch members. This force, when sufficiently strong, moves the latch members radially outwardly so that at least portions of the engagement surfaces thereof interlock with at least a portion of the locking sleeve engagement surface 100 of the locking sleeve 36 when these portions are radially aligned. This radial alignment is achieved after the packers have been set as will be more particularly described hereinbelow.

To provide this communication to the cavity 62, the preferred embodiment actuating pressure communicating means associated with the cavity 62 includes two holes 140, 142 defined by respective transverse walls of the locking mandrel 22. These walls extend between the channel 58 and the transverse cavity 62. In the preferred embodiment these walls are specifically radially extending walls. The actuating pressure communicated through these holes can be derived from the fracturing fluid pumped down through the central channel extending through the entire upper packer section 8 for introduction into the open well bore volume encompassed between the spaced packers of the lower and upper packer sections 6, 8.

The biasing means of the preferred embodiment latch mechanism 54 includes two spring members for each of the latch members. Because the spring members are identical, only the two associated with the latch member 102 shown in FIG. 2B will be described. These spring members are identified by the reference numerals 144, 146. The spring member 144 has a support portion 148 and an engagement portion 150 extending at an obtuse angle from the support portion 148. The spring member 144 is made of a resilient material so that the engagement portion 150 can bend relative to the support portion 148, but with a resulting biasing force being created tending to return the engagement portion 150 to its rest position shown in FIG. 2B. This action provides a biasing force which acts in opposition to the direction of the hydraulic actuating pressure applied through the holes 140, 142 and thereby tends to move the latch member 102 deeper into the cavity 62. This acts as a return force when the actuating pressure is removed.

The support portion 148 is received in the slot 70, and the engagement portion 150 extends as a spring finger into the recess 112 of the latch member 102. The spring member 144 is secured in the slot 70 by suitable connecting means which achieves the aforementioned construction wherein the end of the spring member 144 defined by the engagement portion 150 overhangs the cavity 62 and engages the carrier block 108 within its recess 112 to exert a radially inwardly directed force on the block 108 and thus on the overall latch member 102. This connecting means comprises in the preferred embodiment a spring backup or support member 152 placed adjacent the support portion 148 of the spring member 144, and the connecting means also includes a screw or bolt 154 extending through holes defined in the support portion 148 and the spring support member 152 and into a radially extending threaded bore extending from the slot 70 into the protuberant portion 60 of the locking mandrel 22.

The spring member 146 is constructed and situated similarly to the spring member 144, except that it has a support portion 156 which is secured in the slot 72 by a spring support member 158 and a screw or bolt 160. This allows an engagement portion 162 of the spring member 146 to extend into the recess 114 of the latch member 102. Therefore, the spring member 146 extends in an opposite direction towards the spring member 144 and in a manner so that the engagement portion 162 overhangs the cavity 62 and engages the carrier block 108 to exert a radially inwardly directed force on the block 108.

The biasing means also includes a retaining ring 164 freely disposed between the screws or bolts 154, 160 and partially overlying the spring members 144, 146 and the carrier block 108. The ring 164 acts as a safety backup to prevent the spring members 144, 146 from becoming too outwardly extended.

The hydrostatic pressure communicating means of the latching mechanism 54 includes four radial passages defined through the locking sleeve 36 so that a pressure existing externally of the locking sleeve 36 is communicated internally thereof to exert a radially inwardly directed force on the latch member 102 and, in particular, on the carrier block 108 thereof. These four passages are equally spaced around the circumference of the locking sleeve 36 so that only one, identified as a hole 166, is shown in FIG. 2B. In the preferred embodiment each of these holes has a one-half inch diameter; however, any suitable size hole can be used. The hole 166, and its three counterparts, extend radially through the locking sleeve 36 along the shoulder 95 defined between the offset inner surfaces 92, 94. This provides communication passages for allowing the hydrostatic pressure existing outside the upper packer section 8 and above the packer 26 to be communicated into the volume 91 within the locking sleeve 36 between the seals 52, 82. These holes also allow the hydraulic chamber or volume 91 to fill with fluid as the dual packer assembly 2 is run in the hole, thereby balancing the internal and external pressures across the latch members during this time.

To use the lock, the packer assembly 2 is attached to a tubing or pipe string (not shown) and run into the well bore 4 in a manner as known to the art. When the dual packer assembly 2 is at the appropriate location, the packer 26 and the packer of the lower packer section 6 are set, also in a manner as known to the art. In running this structure into the well bore 4, the inner and outer tubular members of the upper packer section 8 are situated as shown in FIGS. 2A–2F; however, when the packers are set, relative movement between the inner and outer tubular members occurs so that the latch member 102, and the other three latch members disposed in the cavities 64, 66, 68, have at least portions of their latch member engagement surfaces radially aligned with at least a portion of the locking sleeve engagement surface 100. At this time, but prior to a sufficient actuating pressure being applied down through the tubing or pipe string and into the channel 58 of the locking mandrel 22, the spring members of the biasing means are holding the respective latch members in their radial unlatched positions, which are relatively radially inward positions, such as is illustrated by the position of the latch member 102 in FIG. 2B. These latch members are also held in these unlatched radial positions by the hydrostatic pressure existing in the annulus between the locking sleeve 36 and the surface of the well bore 4. This hydrostatic pressure is exerted on the latch members by being communicated thereto through the radial passages of the hydrostatic pressure communicating means (e.g., the hole 166). Locating the lock 18 above the top packer 26 isolates and limits the outside or external force acting radially inwardly on the latch members to the hydrostatic pressure.

When the hydraulic lock of the preferred embodiment of the present invention is to be actuated, whereby the latch members are moved into their engagement positions with the gripping teeth of the latch members interlocking with the locking sleeve engagement surface 100, a fluid is flowed down the tubing or pipe string into the channel 58 and pressurized until a sufficiently strong radially outwardly directed force is exerted through the actuating pressure communicating means (e.g., the holes 140, 142) on each of the latch members. A sufficient force is one which exceeds the forces exerted by the spring members and the hydrostatic pressure. The application of this radially outwardly directed force simultaneously moves each of the latch members radially outwardly to lock the inner tubular member 14 to the outer tubular member 16. This in effect locks the packer 26 to the lower packer section 6 because the inner tubular member 14 is connected to the lower packer section 6 through the lower adapter 24. As long as the tubing pressure exceeds the hydrostatic pressure and the biasing force of the spring members, the latch members lock into the outer housing of the upper packer section 8, thereby preventing upward movement of the top packer 26. Once the fracturing or other actuating pressure is removed, the latch members are returned to their original radially disengaged positions by the hydrostatic pressure and the retracting spring members of the biasing means.

Figure 5A:
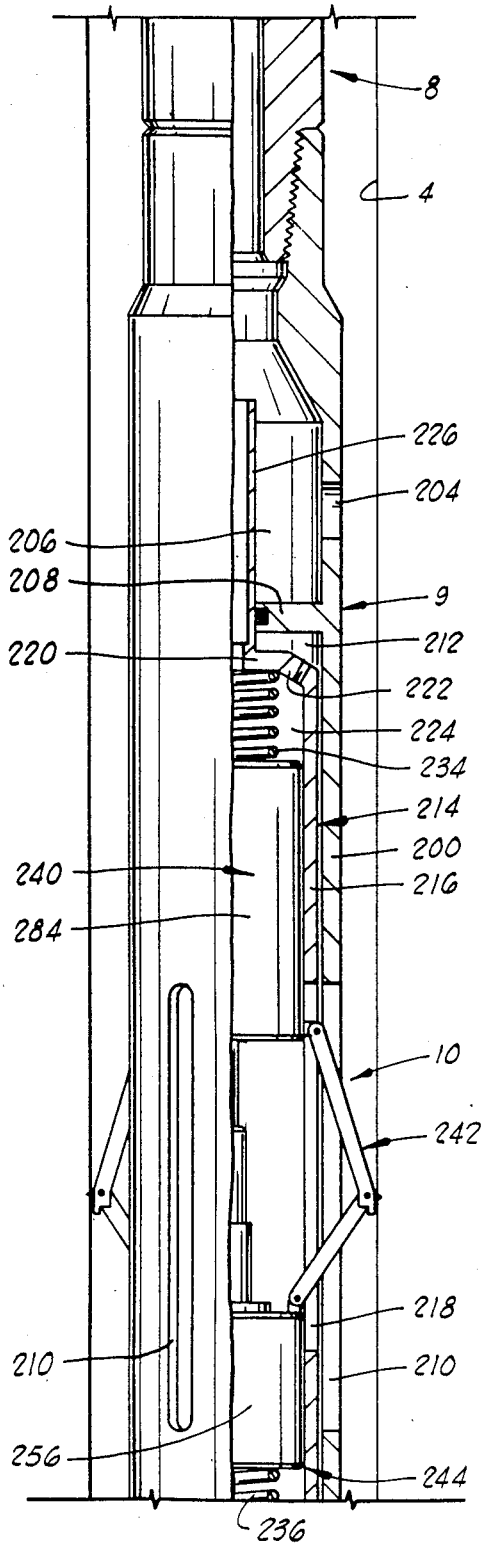
FIGS. 5A–5B illustrate the preferred embodiment structure for mounting the caliper between the packers.
Figure 5B:
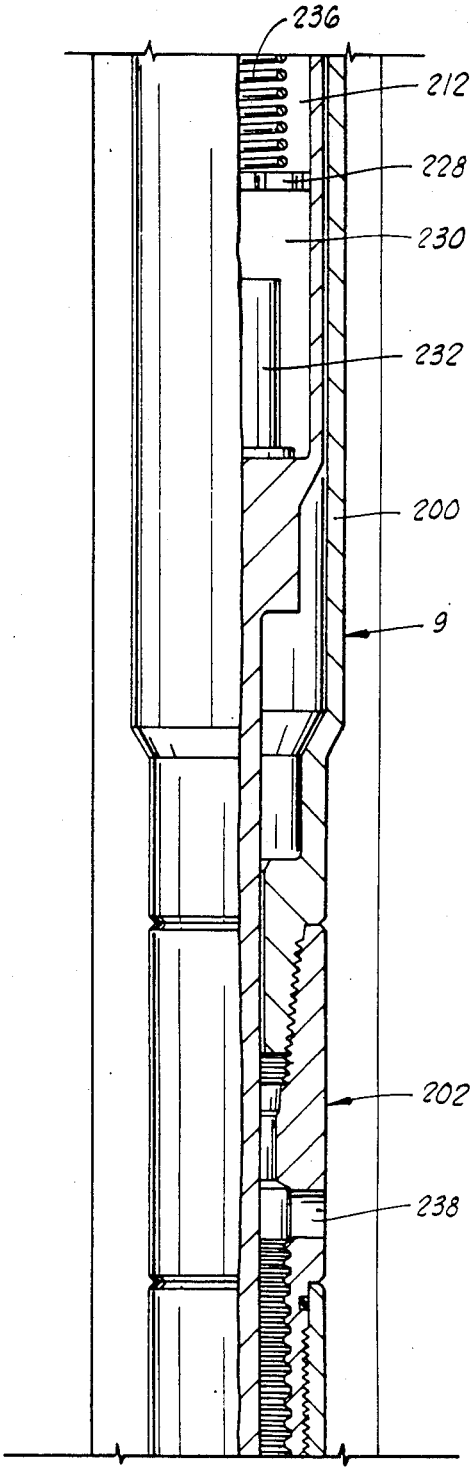

As indicated generally in FIG. 1, mounted between the lower packer section 6 and the upper packer section 8 is the caliper tool 10. The preferred embodiment of a means for mounting the caliper tool 10 between the two packer sections is illustrated in FIGS. 5A–5B. Broadly, this mounting is achieved by retainer means for retaining the caliper 10 between the lower and upper packers so that the caliper is transportable into the well bore with the two packers but so that the two packers are longitudinally movable relative to the caliper when the caliper engages the side wall of the well bore.

This retainer means in the preferred embodiment includes the slotted sleeve 9 shown in FIGS. 5A–5B as having a cylindrical wall 200 having an upper end adapted for connecting with the upper packer section 8 and having a lower end adapted for connecting with the lower packer section 6 through a bypass valve section 202 (directional references, such as "upper" and "lower," are made with regards to orientations shown in the drawings and to normal orientation of the tool 10 in a vertical well bore). Near the upper end of the wall 200 there is defined one or more ports 204 through which fluid flow to or from the interior hollow region of the upper packer section 8 and to or from an upper cavity 206 defined within the slotted sleeve 9 by the portion of the wall 200 through which the ports 204 are defined and by an annular wall 208. Defined through an intermediate portion of the wall 200 are a plurality of slots 210 through which engagement implements of the caliper tool 10 extend as will be more particularly described hereinbelow. The slots 210 are spaced circumferentially around the wall 200 as is apparent in FIG. 5A.

Mounted within a cavity 212 defined in the slotted sleeve 9 below the wall 208 is an inner spring housing 214, which has a lower end (not shown) connected to the anchor pipe to which the lower packer section 6 is connected. The housing 214 has a cylindrical wall 216 through which a plurality of slots 218 are defined. The housing 214 is held within the slotted sleeve 9 so that the longitudinally extending slots 218, 210 are radially aligned so that the extendible implements of the caliper tool 10 can be extended radially therethrough.

The wall 216 terminates at its upper end in an end wall 220 through which an aperture 222 is defined for providing fluid communication between the cavity 212 of the slotted sleeve 9 and a cavity 224 of the spring housing 214. It is within the cavity 224 that the caliper tool 10 is received. Extending axially from the end wall 220 is a wet connector adapter 226 having a cylindrical shape defining a neck within which is defined a throat. The throat receives the wet connector, or an electrical coupling thereof, in a manner as known to the art for making an electrical connection between a wireline and the caliper tool 10.

The lower end of the cavity 224 of the housing 214 is defined by a radial wall 228. The wall 228 defines not only the bottom of the cavity 224, but also the top of a cavity 230 in which a magnetometer 232 is disposed. The magnetometer 232 is one type of device by which the position of the caliper tool 10 relative to magnetic north can be determined. Other position locating instruments such as an inclinometer or a gyroscope can also be used. Alternatively, a pipe tally can be made.

Contained within the cavity 224 of the housing 214 is the caliper tool 10, which is specifically retained within the cavity 224 by an upper spring 234 and a lower spring 236. The spring 234 extends between the inner surface of the wall 220 and a top surface of the caliper tool 10, and the spring 236 extends between a lower surface of the caliper tool 10 and an upper surface of the wall 228 as shown in FIGS. 5A–5B. Thus, the springs 234, 236 and the caliper 10 are held within the housing 214 which is in turn retained within the slotted sleeve 9 connected to the packer sections 6, 8. The springs 234, 236 effect a free-floating mounting construction so that the caliper 10 is free to move longitudinally within the housing 214 which thereby allows movement relative to the packer sections 6, 8. In the preferred embodiment the springs 234, 236 allow approximately one or two inches of longitudinal movement. This is important in the preferred embodiment of the present invention wherein the caliper 10 is directly locked to the well bore 4 once it is placed in use, which locked engagement is not to be disturbed even if the interlocked packer sections 6, 8 should move. The springs 234, 236 also provide cushioning for the caliper tool 10 on its trips into and out of the well bore.

The bypass valve section 202 partially shown in FIG. 5B is of a suitable type as known to the art. It includes at least one port 238 through which fluid can flow when the valve of the section 202 is open. When the valve is open, this allows fluid flow between the upper port or ports 204 of the slotted sleeve 9 and the port 238 of the bypass valve section 202 whereby the fluid flows around the caliper tool 10 and its spring carrier section.

The caliper tool 10 illustrated in FIGS. 5A–5B is only partially shown for purposes of simplicity. The tool 10 is shown as generally including an upper section 240 in which the electronics and the drive motor are supported. Also supported by the section 240 are transducers which respond to the movement of the radially extendible implements of the tool 10. Two of these implements, which are connected at their upper ends to the upper section 240, are identified in FIG. 5A by the reference numeral 242. Other transducers which can be included within the upper section 240 are pressure transducers and temperature transducers and any other suitable ones which can be accommodated within the size constraints of such a downhole apparatus. The extendible members 242 are connected at their lower ends to a lower section 244 which forms part of the drive means for moving the extendible members 242 with independent forces. Force indicating transducers can also be included within the section 244 for indicating the magnitudes of the independent forces applied to each of the extendible members 242. Not shown in FIG. 5A, but part of the preferred embodiment of the caliper tool 10, is a coupling mechanism by which each of the extendible members 242 is connectible to a respective movement detecting sensor contained within the upper section 240. The components of each of these sections will be more particularly described with reference to the preferred embodiments illustrated in FIGS. 6–11.

Figure 6:
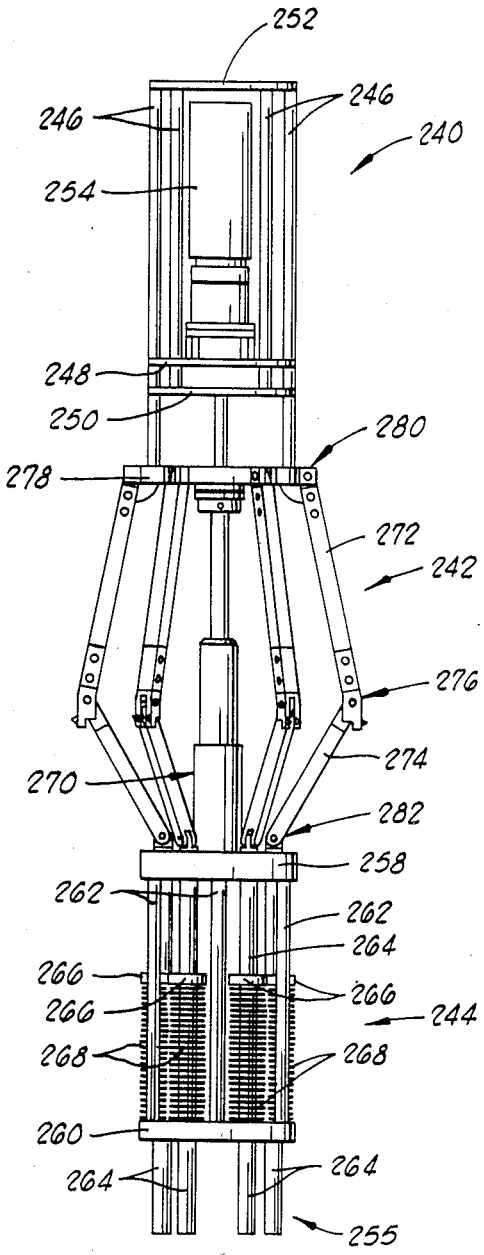
FIG. 6 is an elevational illustration of a basic structure for implementing one preferred embodiment of the caliper of the present invention.
Figure 7:
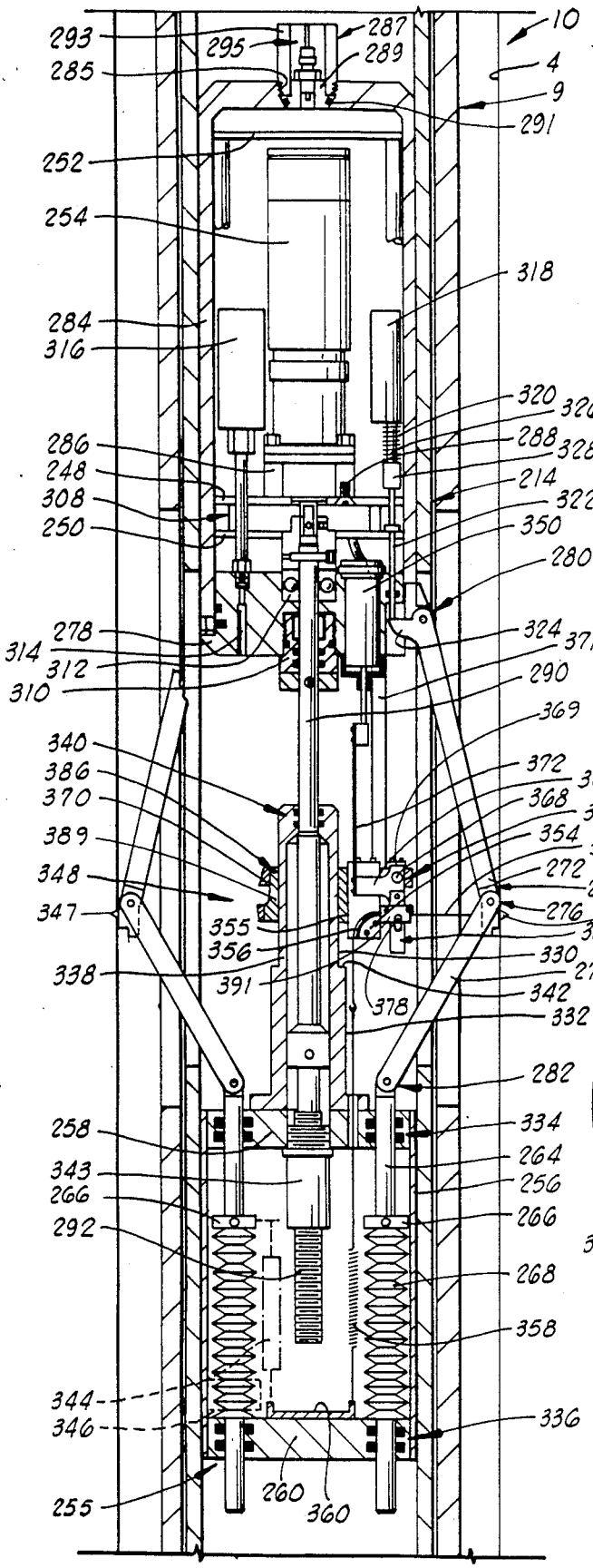
FIG. 7 is a sectional view of the principal portion of another preferred embodiment of the caliper.

The preferred embodiment shown in FIG. 6 has the outer coverings of the upper section 240 and lower section 244 removed to show their general internal constructions. Also removed is the coupling mechanism for coupling the members 242 to the sensors; rather, this coupling mechanism is shown in the embodiment of FIG. 7. The upper section 240 has a plurality of longitudinal support rods 246. Connected to these support rods 246 are two lateral support plates 248, 250 which are longitudinally spaced from each other. An upper end lateral plate 252 is connected to the ends of the rods 246 opposite the plate 248. The rods 246 are spaced near the outer perimeter of the plates 248, 250, 252 so that the working components of the upper section 240 can be mounted interiorly of the rods 246 and between the spaced plates 248, 250, 252. These working components include an electric motor 254 of a suitable type known to the art, such as a standard well logging tool motor. Also mounted in this region are printed circuit boards containing suitable circuitry for conditioning the various electrical signals applied to or generated in the present invention. A motor control circuit for controlling the motor 254 is also included. These circuits are not shown or further described because they are of any suitable type readily known to those skilled in the art for performing the functions of the present invention which will be more particularly described hereinbelow.

The lower section 244 of the embodiment shown in FIG. 6 includes a carriage 255 having an outer covering 256 (shown in FIG. 5A) and end support plates 258, 260 between which connecting rods 262 extend to longitudinally space and support the end plates 258, 260. The end plates 258, 260 have a plurality of longitudinally aligned apertures defined therethrough near their outer perimeters. Spring guide rods 264 are slidably disposed through the apertures. There are six such pairs of apertures and six such spring guide rods in the preferred embodiment to correspond to the six extendible members 242 used in the preferred embodiment. The top end of each of the rods 264 is pivotally connected to the end of a respective one of the extendible members 242 as is shown in FIG. 6.

Each of the spring guide rods 264 has a retaining collar 266 for retaining a respective spring 268 between the support plate 260 and the collar 266. The springs 268 are compressed in response to suitable movement of the carriage which occurs through a ball screw coupling mechanism 270 which couples the carriage 255 to the motor 254.

In response to longitudinal movement of the carriage 255 of the lower section 244, each of the extendible members 242 is radially moved inwardly or outwardly depending upon the longitudinal direction of movement of the carriage. Each of the members 242 defines a pivot arm comprising a longer strut or arm section 272 and a shorter strut or arm section 274 which are pivotally connected at a pivot joint 276. The end of the strut 272 opposite the pivot joint 276 is pivotally connected to a retaining plate 278 of the upper support section 240 at a pivot joint 280. The end of the strut 274 opposite the joint 276 is connected at a pivot joint 282 to a respective portion of the support plate 258. These pivot connections are of any suitable type, such as a pin and clevis type of coupling where a bifurcated portion is pinned to a retaining tab received between the bifurcations.

A more detailed description of at least some of the foregoing elements and the functions of these elements will be more particularly described with reference to the embodiment shown in FIGS. 7–11, which embodiment shows a more detailed construction than is shown in the FIG. 6 embodiment. It is to be understood that the embodiments shown in FIGS. 6 and 7–11 have many similar components and are functionally identical. Common or similar items between the FIG. 6 and FIG. 7 embodiments are indicated by like reference numerals.

The upper section of the embodiment shown in FIG. 7 includes a support framework similar to that shown in FIG. 6. It is also shown in FIG. 7 to be enclosed in a covering or housing 284. The housing 284 is positioned adjacent the housing 214. The housing 284 is connected to the support wall, or bulkhead, 278 by screws or other suitable means.

Attached into a beveled aperture 285 defined axially in the top wall of the housing 284 is a wet connector adapter 287. The adapter 287 includes a beveled plug 289 having a seal member 291 retained thereon. The plug is secured in the beveled aperture 285 by a cylindrical threaded receiving sleeve 293 threadedly connected into the aperture 285. The sleeve 293 receives a wet connector member 295 when it is lowered into the well bore at the end of a wireline. In the preferred embodiment the wet connector tool from which the member 295 extends is of any suitable type, such as of a type used by Welex, but adapted for the particular use with the present invention. One feature of such an adaptation could be to use a slip joint construction intermediate the wet connector tool and the member 295. Such a slip joint would accommodate the approximately seven inches of vertical displacement that can be encountered in setting the upper packer section of the preferred embodiment.

The upper section of the embodiment shown in FIG. 7 includes the motor 254 mounted on a support bracket 286 which is connected to the support plate 248 by screws, one of which is identified by the reference numeral 288. The shaft of the motor is coupled to a coupling or connecting rod 290 which connects the motor shaft to a ball screw shaft 292 of the ball screw coupling mechanism 270. Associated with the drive shaft of the motor 254 and the connecting shaft 290 is a gear 294 shown in FIG. 9. The gear 294 is associated with four other gears 296, 298, 300, 302 to provide a gear drive sized to count twenty-two rotations of the ball screw shaft 292 in the preferred embodiment. When these twenty-two revolutions have occurred, a pin 304 on the gear 302 engages an upward direction limit switch of limit switches 306. This deactivates the motor 254 from further driving the ball screw shaft 292. These gears and the limit switch are located in a compartment or region 308 shown in FIG. 7 to be disposed between the longitudinally spaced plates 248, 250. A roller bearing 310 and a thrust bearing 312 are used to provide suitable support to the shaft 290. These bearings are supported in oppositely facing cavities axially defined in the bulkhead 278. This is an alternative construction of the bulkhead from the thinner one shown in the FIG. 6 embodiment. In the FIG. 6 embodiment, thrust bearings are mounted on both sides of the bulkhead block.

Also defined through the bulkhead 278 is a channel 314 which communicates pressure to a pressure transducer 316 coupled to the channel 314 and mounted within the upper section of the embodiment shown in FIG. 7. In the preferred embodiment this pressure transducer is of a type known to the art for detecting a pressure within the range between 0 and 5,000 pounds per square inch. This is thus capable of measuring the pressure existing in the well bore as communicated to the channel 314 through the slots in the sleeve 9 and the housing 214.

Also mounted in the upper section of the embodiment shown in FIG. 7 are a plurality of means for measuring the total radial distance each of the extendible implements 242 moves in response to the motor 254 and other drive components contained in the lower section of the preferred embodiment of the caliper tool 10. In the preferred embodiment each of these measurement means is a resistance potentiometer 318 having an actuating arm 320 coupled to a connecting rod 322 which engages a protuberant shoulder portion 324 of the respective pivot arm 242 under biasing of a spring 326 shown mounted between the body of the device 318 and a coupling/retaining collar 328. Because of this direct and continuous engagement between the coupling rod 322 and the shoulder 324, the potentiometer 318 generates an electrical signal which is proportional to the total movement of the respective pivot arm. Because there are six pivot arms in the preferred embodiment, there are also six potentiometers 318. The potentiometers 318 associated with oppositely disposed ones of the arms are paired so that the signals generated by each pair gives an indication of the total diameter or transverse dimension of the well bore defined across the respective pair of pivot arms. Each potentiometer 318 and its connecting rod 322 are mounted longitudinally in the upper section of the caliper tool 10. The protuberant shoulder 324 is shaped so that it maintains contact with the end of the rod 322 throughout the full range of radial movement of the respective pivot arm.

Although not shown in the drawings, also included in the upper section of the preferred embodiment of the caliper tool 10 is a temperature transducer of a type as known to the art. For example, one having a range of up to 500° F. could be used.

The lower section of the embodiment shown in FIG. 7 has elements similar to the corresonding lower section of the embodiment shown in FIG. 6 as indicated by the use of the same reference numerals. The view shown in FIG. 7, however, is of a section of the spring guide rods 264 without showing the connecting rods 262. Also, only two of the pivot arms 242 are shown in FIG. 7 to simplify the drawing; however, each of the six arms 242 is similarly constructed to the one fully described hereinbelow. This view also shows the ball screw coupling mechanism 270 and other features of the preferred embodiment lower section 244 not shown in FIG. 6. As to the rods 264, FIG. 7 shows that each passes through respective upper and lower seals 334, 336 which have equal areas to provide pressure balancing between the seals. The seals 334 are retained in the support plate 258, and the seals 336 are retained in the support plate 260.

Extending axially from the support plate 258 is a neck portion 338 into which the lower portion of the coupling rod 290 and the upper portion of the ball screw shaft 292 extend and couple. A seal 340 mounted at the top of the neck portion 338 sealingly engages the rod 290. The neck portion 338 has a stepped or offset outer appearance whereby a radial annular shoulder 342 is defined between cylindrical, longitudinal surfaces 330, 332.

Mounted below the support plate 258 opposite the neck portion 338, but axially aligned therewith, is a ball screw sleeve 343 which cooperatively receives the ball screw shaft 292. The sleeve 343 cooperates with the carriage 255 so that rotation of the shaft 292 drives the carriage up or down depending upon the direction of rotation Depicted by dashed lines in FIG. 7 are alternative embodiments of a sensor means for generating respective electrical signals corresponding to the force exerted by a respective one of the plurality of springs 268. There can be one such sensor means for each combination of spring guide rod 264 and spring 268. One of these alternative embodiments is a linear potentiometer 344. There is one such potentiometer connected to a respective one of the spring guide rods 264 (such as specifically to the respective retaining collar 266) so that the respective potentiometer generates an electrical signal corresponding to the displacement of the respective retaining collar 266 and thus of the respective spring 268. Knowing the nature of the spring, one can use this displacement to determine the force exerted by the spring. An alternative device is a load cell 346, mounted colinearly beneath the respective spring, for generating an electrical signal proportional to the load. Use of either of these devices, or of any other suitable device by which the force exerted by each respective spring can be determined, is useful for providing information from which in situ stress measurements can be made, particularly in association with the deflection measurements taken in response to movements of the extendible arms 242. One specific measurement that can be derived is the hardness factor of the formation.

From the foregoing descriptions of the upper and lower sections of the caliper tool 10, it is readily apparent that the motor 254, the coupling rod 290, the ball screw coupling mechanism 270, the carriage 255, and the rod 264/spring 268 assemblies are combined to define the preferred embodiment of a drive means for commonly moving all six of the pivot arms 242 so that the pivoted joints 276 of the arms are simultaneously moved outwardly from the caliper tool 10 and for exerting independent forces on the pivoted arms for application to the well bore 4. This occurs when the motor 254 moves the carriage longitudinally upwardly as viewed in either FIG. 6 or FIG. 7. This movement occurs until the pin 304 of the gear 302 engages the upward direction limit switch of the limit switches 306. Oppositely, these components retract the pivoted arms 242 radially inwardly when the motor 254 drives the carriage in the longitudinally opposite direction until the pin 304 engages the downward direction limiting switch of the switches 306.

When the arms 242 are extended radially outwardly into engagement with the well bore 4, engagement with the well bore occurs through points or tips 347 connected to the ends of the sections 272 of the arms 242. In the preferred embodiment, two of the arms 242 are provided with carbide points for penetrating the formation to rigidly lock the caliper tool thereto, and the other four arms are provided with more rounded points. In the preferred embodiment it is anticipated that the holding force applied to any one of the arms can be up to 250 pounds; however, any suitable force can be designed for by using an appropriate type of compression spring for the springs 268. The particular magnitude of force applied by any one spring depends on how far the respective pivot arm is extended, which depends on the size and shape of the well bore.

The final principal structural part of the preferred embodiment of the caliper tool 10 to be described is the means by which deformations of the well bore are detected. This means is contained substantially centrally within the caliper tool 10. This means is generally identified in FIG. 7 by the reference numeral 348. This includes sensor means for sensing movements of the pivot arms when the sensor means are coupled to the pivot arms. There is one such sensor means for each of the six pivot arms in the preferred embodiment. The means 348 also includes actuating means for actuating each of the sensor means after the drive means has pivoted the pivot arms 242 into engagement with the side wall of the well bore 4 so that each of the sensor means senses only movements of the pivot arms occurring after the pivot arms are pivoted into such engagement with the side wall of the well bore.

Each sensor means includes a displacement measurement means, connected to the support member defined by the upper section 240 of the caliper tool 10, for generating an electrical signal in response to movement of the respective one of the pivot arms associated with that displacement measurement means. In the preferred embodiment the displacement measurement means is a linearly variable differential transformer transducer of a suitable type known to the art, such as a Schaevitz XS-C series transducer (e.g., model 149 XS-C). This type of transducer has only a limited range of total measurable linear displacement (e.g., +0.15 inch), but within that range a precision of 0.0001 inch or smaller is provided. This permits the well bore deformations (which are anticipated to be no more than approximately 0.1 inch) to be measured by the present invention with a resolution of at least 0.001 inch.

One of these transducers is identified by the reference numeral 350 in FIG. 7. Each transducer 350 has a body mounted longitudinally in the preferred embodiment within the housing of the upper section 240. Slidably disposed within the body is a movable member, sometimes referred to as an armature, which moves longitudinally relative to the caliper tool 10. This mounting is longitudinal in the preferred embodiment because of space limitations; however, it is contemplated that other dispositions of the transducers can be achieved if suitable transducers and tool sizes can be accommodated. When the movable member slides within the transducer body, an electrical signal is generated. When the movable member is connected to the respective arm 242, this signal is generated in response to movement of the arm 242 brought about by deformation of the well bore 4.

Figure 10:
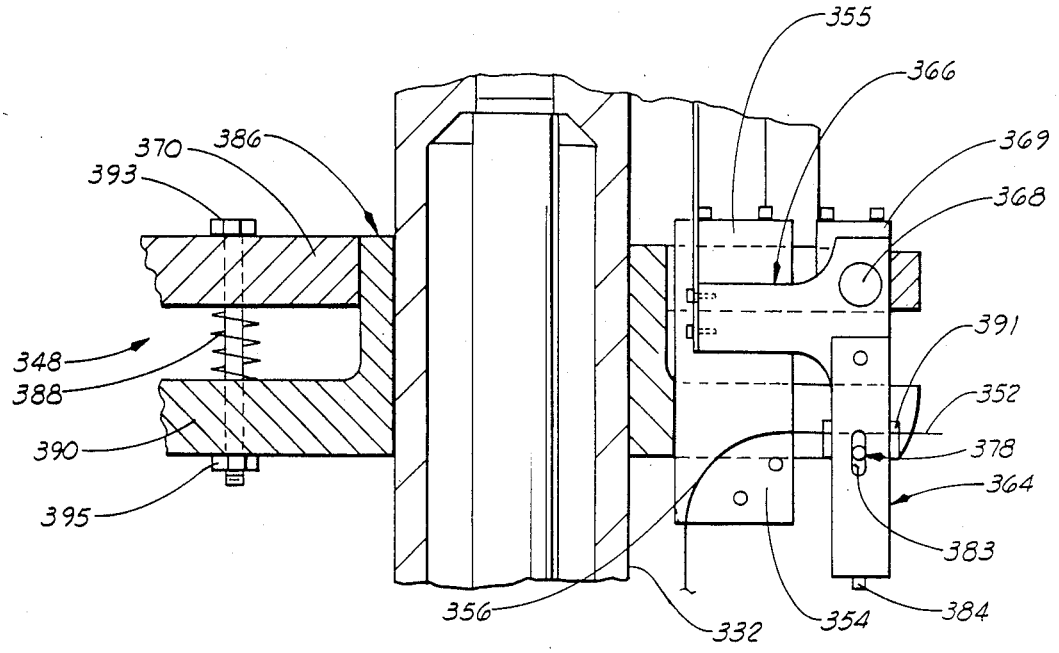
FIG. 10 is an enlarged view of a portion of a clutch and spider coupling subassembly also shown in FIG. 7.

This deformation sensor means also includes connecting means for releasably connecting the respective one of the pivot arms 242 to its respective transducer 350. This connecting means includes a coupling line extending from the pivot arm 242. In the preferred embodiment this coupling line is a connector strap 352 which is a long thin strip of stainless steel having one end connected in alignment with the pin or tip 347 contacting the formation at the pivot joint 276. The strap 352 extends through an engagement means, subsequently described, and around a guide shoe 354 having a curved edge 356 along which the strap extends and bends 90° so that the other end of the strap extends transversely to the first-mentioned end of the strap, which firstmentioned end extends transversely to the longitudinal direction of the caliper 10. The guide shoe 354 is mounted on an L-shaped bracket 355 which is connected by two Allen screws to a circular support plate 370 as shown in FIGS. 7 and 10.

This other end of the strap 352 is connected by suitable means to the carriage 255 of the drive means. In the preferred embodiment this is accomplished by a spring 358 located within the carriage 255 as shown in FIG. 7. The spring 358 has one end connected (such as by a hook and eye connection) to the strap 352 and has its other end connected to a connecting plate 360 attached to the bottom support plate 260. The spring 358 is used to eliminate slack and keep tension on the strip or strap 352 at all times in view of the difference in ratio of the two lever sections or struts that make up the extendible arm 242 and further in view of the non-linear travel ratio between the contact point of each arm and the spring drive assembly in the lower section of the caliper 10. This tension does not adversely affect the measuring system once the strap 352 is locked in its measuring position.

To lock the strap 352 in its measuring position, the connecting means of the deformation sensor means includes the aforementioned engagement means which is used for engaging the coupling line with the respective transducer 350 when the engagement means is in an engagement position and for disengaging the coupling line from the transducer when the engagement means is in a disengagement position. This engagement means in the preferred embodiment clamps the strap 352 to the movable member of the respective transducer 350 in response to the actuating means which in turn is responsive to the drive means. This clamp means includes an L-shaped lever or elbow member 362 having arm sections 364, 366 connected in transverse (specifically, perpendicular) relationship to each other. The arm section 364 includes a fork element 365 (see FIG. 8) having an open bifurcated end which receives and is screwed or otherwise suitably connected to a transverse extension integrally formed with the arm section 366 but forming part of the arm section 364.

This member 362 is used to accommodate the 90° change in direction between the direction of wall deflection and the direction of the travel of the movable member, or armature, of the transducer 350 when the transducer 350 is mounted longitudinally as illustrated in FIG. 7. In the preferred embodiment the elbow member 362 has a one-to-one ratio supported on a Bendix flexure spring pivot 368 secured to an L-shaped bracket 369 connected by Allen screws to the support plate 370 as shown in FIGS. 7 and 10. The plate 370 is connected by elongated members 371 as part of the framework of the upper section 240 of the caliper tool 10. This type of connection provides a spring pivot that allows precise centering of the rotation of the L-shaped lever 362 with almost no friction and hysteresis. These devices have substantially zero backlash which is of utmost importance when measuring for resolution on the order of 0.001 inch, as is to be done in the preferred embodiment of the present invention. Therefore, this design and mounting of the elbow member 362 allows for automatic centering of the armature or movable member in the transformer 350 when the member 362 is disengaged from the respective arm 242. This armature is connected to the arm 366 of the lever 362 by a small thin strip 372, which is connected thereto by screws as illustrated in FIG. 7. This thin strip, which in the preferred embodiment is on the order of 0.004 inch thick and between 0.187 inch to 0.025 inch wide and made of stainless steel, is used so that displacement movement passes at a precise distance from this flexure pivot and so that any side load due to rotation of the L-shaped member 362 is relieved.

Figure 8:
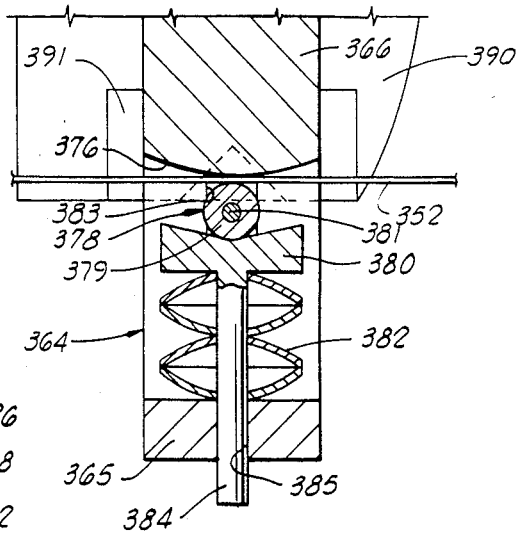
FIG. 8 is a detailed view of a latch mechanism in the preferred embodiments of the caliper.
Figure 11:
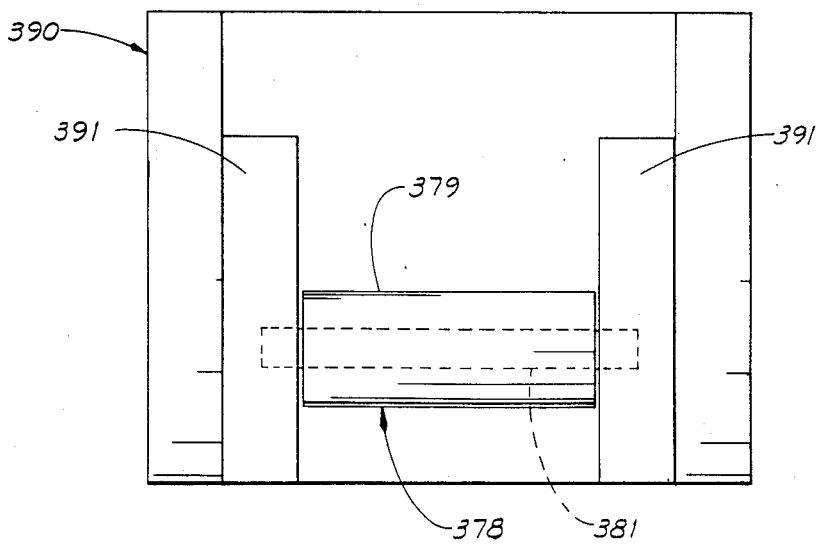
FIG. 11 is a partial end view of a spider arm, to which pawls are connected, and a clutch roller member engaged by the pawls.

To lock one strap 352 to one elbow member 362 (there is one of each for each pivot arm 242) so that movement of the respective pivot arm 242 is coupled through the respective elbow member 362 to the armature of the respective transducer 350, the arm portion 364 of the elbow member 362 has a self-locking spring loaded clutch mechanism having a preferred embodiment shown in FIG. 8. The fork element 365 of the arm portion 364 is connected to the transverse extension from the arm portion 366 so that a curved surface 376 on this transverse extension lies within the central opening of the bifurcated extensions of the fork element 365. The strap 352 can be clamped to the surface 376 by a clutch roller member 378, which comprises a cylindrical sleeve 379 and a cylindrical pin 381 extending axially through and beyond both ends of the sleeve 379 as shown in FIG. 11. The member 378 is urged into frictional engagement with the strap 352 by a holding piston or anvil 380 biased towards the strap 352 by a spring 382. This construction allows a connection which communicates well bore deformation between the pin 347 engaging the formation and the armature of the transformer 350 with little or no backlash of the one-to-one ratio coupling system.

The roller 378, by means of its pin 381, has two smaller diameter ends which are received in aligned slots 383 of the fork element 365. One of these slots 383 is shown in FIG. 8. A larger diameter central cylindrical portion, defined by the sleeve 379, of the member 378 extends between the slots so that the roller 378 does not inadvertently come out of these slots.

The anvil 380 and the spring 382 are received in the central opening of the fork element 365 so that they can move longitudinally as guided by a guide rod 384 of the anvil 380. The guide rod 384 passes through a hole 385 defined through the closed end of the fork element 365. The face of the anvil 380 biased by the spring 382 towards the roller 378 is shown in FIG. 8 as having a shallow slope converging to a central area which contacts the roller 378. The slope of this convergence is kept shallow (e.g., less than approximately 13°) to make the clutch mechanism self-locking when it is released to engage the roller 378.

Movement of the roller 378 in opposition to the biasing force exerted by the spring 382 is effected by means of the actuating means which in the preferred embodiment includes a spider 386 mounted for relative movement between the support plate 370 and the respective rollers 378. Coil springs 388, one of which is shown in FIG. 10, are held between the support plate 370 and the spider 386 to bias the spider 386 towards the rollers 378. Although FIG. 10 shows a bolt 393 and a self-locking nut 395 associated with the spring 388, such nut and bolt are used for assembly but are not required to hold the plate 370 and the spider 386 together after assembly as is apparent when viewing the overall assembly in FIGS. 7 and 10. The spider 386 has a central cylindrical hub 389 from which extend radial fingers, one of which fingers is identified in FIGS. 10 and 11 by the reference numeral 390. There are six such fingers, each of which is associated with a respective one of the pivot arms 242 and the accompanying connecting assembly. Each finger 390 is bifurcated, and each bifurcation has connected to its outer end a pawl 391 having a groove for receiving the respective end of the pin 381 of the roller 378 when the springs 388 urge the pawls 391 towards their respective aligned clutches having the rollers 378. Different aspects of this construction are illustrated in FIGS. 7–11. The hub 389 has an axial channel through which the rod 290 is slidingly received.

The springs 388 bias the spider 386 towards a spider engaged position wherein each pawl 391 engages the respective pin 378 aligned therewith and moves it to its clutch disengaged position away from the respective strap 352. Thus, the cumulative force exerted by the springs 388 is greater than the cumulative force exerted by the springs 382 within the elbow members 362 in the preferred embodiment.

The spider 386 is moved in response to movement of the drive means to a spider disengaged position, wherein the pawls 391 of the spider 386 disengage from the pins 378 so that each pivot arm 242 is thereby connected to its respective transducer 350 under the engagement force exerted by the springs 382. In the preferred embodiment shown in FIG. 7, this occurs when the carriage 255 is moved sufficiently longitudinally upwardly that the shoulder 342 of the neck portion 338 engages the lower surface of the hub 389 of the spider 386 and moves the spider longitudinally upwardly. This occurs in the preferred embodiment just prior to the gearing assembly illustrated in FIG. 9 counting the twenty-two revolutions and engaging the upward direction limiting switch. Specifically, when the pivot arms 242 are fully retracted within the tool 10, the shoulder 342 is spaced three inches below the bottom surface of the hub 389. As the drive motor 254 rotates the screw shaft 292 to extend the pivot arms 242, the upper and lower sections 240, 244 move relatively towards each other and the hub 389 moves relatively towards the shoulder 342. After a sufficient length of this relative movement between the hub 389 and the shoulder 342, the shoulder enages the hub; however, this point of engagement is reached before the twenty-two revolutions of the screw shaft have been counted. Thus, the shaft continues to rotate so that the shoulder 342 pushes the spider 386 against the springs 388 towards the support plate 370. This continues for another ¼ inch when the twenty-two rotation count is reached, thereby stopping further operation of the drive motor 254. This movement is related so that the pivot arms 242 are moved into engagement with the well bore before the last ¼-inch linear movement of the shoulder 342. This keeps the clutches in the elbow members 362 disengaged until after the pivot arms 242 engage the well bore. A clutch disengaged position is illustrated in FIGS. 7 and 10, and a clutch engaged position is illustrated in FIG. 8.

Therefore, when the spider 386 is in its full downward position relative to the support plate 370, the pawls 391 engage the rollers 378 and hold them at their clutch disengagement positions wherein the clamp members defined by the rollers 378 release the straps 352. When the spider 386 is in its upwardmost position relative to the support plate 370 so that the pawls 391 disengage the rollers 378, this allows the rollers 378 to be automatically biased by the springs 382 towards the straps 352 to engage them and thereby hold them adjacent the engagement surfaces 376 of the elbow members 362.

Both in summary and supplementation of the foregoing, the caliper tool 10 is used to measure the deformation of the well bore 4, such as an expansion thereof occurring in response to a fracturing process. In the preferred embodiment the diameter of the tool 10 was chosen to be approximately eight inches in view of the general size of well bores with which the tool is contemplated to be used. To adequately cover changes in the shape of the well bore, a six-arm design is used in the preferred embodiment of the tool 10. The six arms 242 are uniformly spaced at 60° displacements around the central section of the tool 10. The corresponding transducers 350 associated with the arms 242 are likewise arranged within the tool 10 at 60° spacings. These are located around the interior of the tool 10 so that the center is left open for the single motor 254 used in the preferred embodiment and the single main power shaft driven by the motor 254.

In the preferred embodiment of the overall tool of the present invention, the caliper 10 is supported by springs on each end between upper and lower packer sections. These springs are of a type which allow for approximately one to two inches of longitudinal freedom of movement of the caliper 10 between the upper and lower packer sections. The instrument carrier section in which the caliper 10 is housed between the packer sections has six slots through which the arms 242 extend into contact with the formation intersected by the well bore 4. The preferred embodiment of the caliper 10 receives and sends electrical signals over a wireline extended through the well bore and the upper packer section into connection, via a wet connector, at the top of the caliper 10.

One principal feature of the preferred embodiment is that each of the arms 242 is mechanically fixed to two portions of the caliper tool to provide an increased degree of rigidity required for making the precise measurements taken with the present invention.

Another feature of the preferred embodiment is that each of the arms 242 is driven by an independent force, but from a common, single power source. This independent drive force is important because the well bores to be measured are not absolutely round so that each arm 242 will likely need to be moved a different radial distance. These differences are accommodated in the preferred embodiment by using individual compression springs on the end of each arm. This yields different force loads on each of the arms. In the preferred embodiment it is anticipated that the arms move no more than approximately 0.1 inch during measurement of a formation deflection; therefore, it is desirable to exert through the springs 268 contact forces or pressures up to approximately 250 pounds of force. This is effected by appropriate selection of spring characteristics. Suitable types of springs include helical springs or Bellville spring washers.

Still another feature of the present invention is the means by which the precise measurements are obtained. Although in the preferred embodiment a caliper arm may have to extend on the order of approximately two inches from its fully retracted position within the caliper tool 10 to its engagement position coupling with the well bore 4, the range of precision transducers is more limited, such as between ±0.015 for full-scale deflections. This is a limitation of the linearly variable differential transformer 350 used in the preferred embodiment; however, this limitation is offset by the precision achieved by such a device. This transducer has a multicoil cylindrical configuration with a central movable armature which slides longitudinally relative to the coils, thereby causing the output voltage to vary linearly with the armature displacement. No electronic amplifiers are required so that less support circuitry is needed. Furthermore, a single known type of integrated circuit chip supports these types of devices. It is contemplated that suitable transducers are currently available for use in the preferred embodiment of the present invention which requires resolving increments of 0.001 inch for ±0.1 inch of travel. Because such a device could not provide appropriate output over the full range of travel from the fully retracted position within the tool 10, the present invention utilizes the clutch mechanism to lock the precision measuring transducers 350 to the arms only after the arms are in their engaged position with the well bore 4 (more specifically, only after the screw shaft has rotated a predetermined number of times).

The operation of the preferred embodiment of the present invention is as follows. Power is provided through the aforementioned wireline to the caliper tool 10 after the upper and lower packers have been set and the wet connector has been attached in manners as known to the art. In the preferred embodiment, the packers are locked by the locking mechanism found in the upper packer section 8. Power for operating the motor 254 is contemplated to be provided at 60 hertz, power to the instrument section is contemplated to be at 400 hertz, and the data signals are contemplated to be sequential DC levels.

When a suitable signal is first applied to the tool 10, the motor 254 is actuated to rotate in a direction which draws the upper and lower sections 240, 244 longitudinally closer together so that the arms 242 are pivoted radially outwardly. This is accommodated in a contemplated particular embodiment by releasing an electric brake on the electric motor, actuating an alternate action relay to select the appropriate motor coil controlling the direction of rotation of the drive shaft, and bypassing a closed limit switch.

Figure 9:
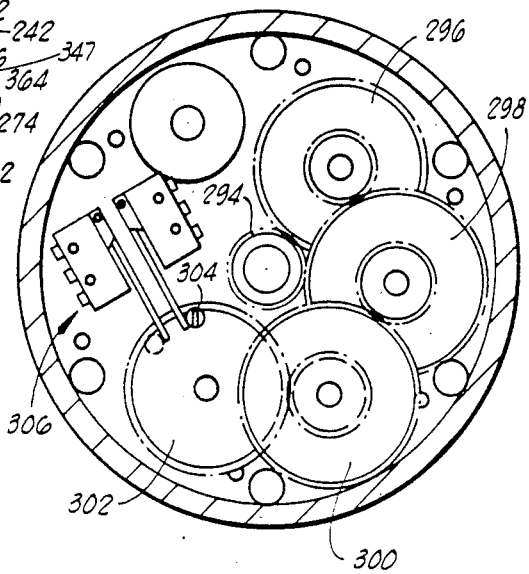
FIG. 9 depicts the limit gearing of a drive mechanism of the preferred embodiments of the caliper.

As the motor rotates its drive shaft to open the caliper arms, the gears shown in FIG. 9 rotate in correspondence to the main drive shaft. When twenty-two revolutions have occurred, the gears have been rotated so that the pin 304 engages the appropriate limit switch which deactivates the motor 254. During at least part of this maximum movement, the load is transferred to the compression springs 268 on each of the spring guide rods 264. As this load is transferred, the spring guide rods 264 move relative to the spring container carriage 255 (specifically, relative to the plates 258, 260). Sufficient movement of this carriage causes the neck portion 338 thereof to engage the spider 386. Sufficient movement of the spider 386 releases the rollers 378 so that the straps 352 are clamped to their respective transducers 350 through the interconnecting couplings.

A second control signal actuates the downhole electronics to measure or record the data obtained through the various transducers. This is performed in a manner as known to the art. To determine the amount of bore wall deflection from these data, a first reading is made when the transducers 350 are first clamped to the pivot arms 242. This provides base or "zero point" information. The fracturing fluid is then applied and another reading of the transducers 350 taken. The differences between these data and the first data are the amounts of detected movement.

When the motor controlling signal is removed from the motor 254, an electric brake on the motor locks the motor shaft to keep the drive shaft from creeping. The alternate action relay releases and resets to its next action of allowing the motor to reverse and retract the measuring arms the next time a suitable control signal is applied to the motor 254. The limiting function of the limit switch is bypassed so the electric motor will operate during its next cycle. This next application of a suitable signal causes the motor to reverse and retract the arms. A limit switch detects when the linear movement in this direction has been reached.

Once the pivot arms are retracted, another control signal is sent to again activate the downhole electronics for purposes and in a manner as known to the art.

Thus, the present invention is useful for detecting movements or deformations of a well bore and thus provides information useful for determining hole orientation and fracture height. The caliper of this invention utilizes a single drive motor and means for exerting a respective independent force on each of several pivot arms in response to the operation of such motor. The caliper is capable of providing precise measurements of detected deflections within a narrow range, which measurements can be taken only after the arms have been extended sufficiently and a clutch mechanism released to clamp the arms to respective precision transducers. Furthermore, this invention utilizes a free-floating construction wherein the caliper is mounted on springs between two interlockable packers. The caliper rigidly holds itself to the formation by the arms which are mechanically restrained at both ends to provide a rigid holding action with the formation.

Thus, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A well bore measurement tool for a well bore having a side wall, comprising:

lower packer means for providing a lower seal in the well bore;

upper packer means for providing an upper seal in the well bore;

caliper means for measuring a deflection of the side wall of the well bore; and retainer means for retaining said caliper means between said lower and upper packer means so that said caliper means is transportable into the well bore with said lower and upper packer means but so that said lower and upper packer means are longitudinally movable relative to said caliper means when said caliper means engages the side wall of the well bore.

2. A tool as defined in claim 1, wherein said retainer means includes:

a first spring;

a second spring; and means for holding said first spring in between said upper packer means and said caliper means and for holding said second spring in between said lower packer means and said caliper means.

3. A tool as defined in claim 1, further comprising lock means for locking said upper packer means to said lower packer means.

4. A tool as defined in claim 1, wherein said caliper means includes:

a support member;

a plurality of pivot arms connected to said support member;

drive means, connected to said pivot arms, for pivoting said pivot arms outwardly from said housing;

a plurality of sensor means for sensing movements of said pivot arms, each of said sensor means including:

displacement measurement means, connected to said support member, for generating an electrical signal in response to movement of a respective one of said pivot arms; and connecting means for releasably connecting the respective one of said pivot arms to said displacement measurement means; and actuating means for actuating each said connecting means to connect the respective one of said pivot arms to the respective one of said displacement measurement means after said drive means has pivoted said pivot arms into engagement with the side wall of the well bore so that each of said sensor means senses movements ments of said pivot arms occurring after said pivot arms are pivoted into engagement with the side wall of the well bore.

5. A tool as defined in claim 4, wherein said caliper means further includes a plurality of means for measuring the total radial distance each of said pivot arms moves in response to said drive means.

6. A tool as defined in claim 4, wherein said drive means includes:

one, and only one, motor; and means, responsive to said motor, for exerting a respective independent force on each of said pivot arms.

7. A tool as defined in claim 6, wherein said actuating means includes a member movable to a disengaged position, wherein said member disengages from said connecting means so that each pivot arm is thereby connected to its respective displacement measurement means, in response to movement of said means for exerting a respective independent force on each of said pivot arms.

8. A well bore measurement tool, comprising:

a support member;

a plurality of pivot arms, each of said arms including a first section having a first end pivotally connected to said support member and having a second end, and each of said arms further including a second section having a first end pivotally connected to said second end of said first section and having a second end; and drive means, connected to said support member and connected to said second ends of said second sections of said pivot arms, for commonly moving said pivot arms so that said second ends of said first sections and said first ends of said second sections are simultaneously moved outwardly from said support member and for exerting independent forces on said pivot arms said drive means including:

a carriage;

a plurality of spring guide rods slidably disposed in said carriage, each of said rods connected to the second end of the second section of a respective one of said pivot arms;

a plurality of springs, each of said springs mounted on a respective one of said rods; and means, connected to said support member and said carriage, for moving said carriage relative to said support member, wherein said carriage has longitudinally spaced first and second ends, said first end of said carriage disposed nearer than said second end of said carriage to said pivot arms and said first and second ends of said carriage having longitudinally aligned apertures defined therethrough, each pair of said aligned apertures slidingly receiving a respective one of said rods; and said drive means further includes:

seal means, disposed in each of said apertures, for providing balanced pressure seals between said carriage and said rods; and a plurality of retaining collars, each of said collars disposed on a respective one of said rods between said first and second ends of said carriage so that the respective one of said springs mounted on the respective one of said rods extends between the respective one of said collars and said second end of said carriage.

9. A tool as defined in claim 8, wherein said means for moving said carriage within said housing includes:

a single electric motor; and coupling means for coupling said motor to said carriage.

10. A tool as defined in claim 8, wherein said means for moving said carriage within said housing includes:

a single electric motor; and coupling means for coupling said motor to said carriage.

11. A tool as defined in claim 8, comprising:

a plurality of sensor means for sensing movements of said pivot arms, each of said sensor means associated with a respective one of said pivot arms and each including:

transducer means, connected to said support member, for converting a sensed movement of the respective one of said pivot arms into a corresponding electrical signal;

a coupling line extending from the respective one of said pivot arms; and engagement means for engaging said coupling line with said transducer means when said engagement means is in an engagement position and for disengaging said coupling line from said transducer means when said engagement means is in a disengagement position; and means, responsive to movement of said carriage, for moving said engagement means between said engagement and disengagement positions.

12. A tool as defined in claim 8, further comprising sensor means, connected to said support member, for generating respective electrical signals corresponding to the forces exerted by each of said plurality of springs.

13. A well bore measurement tool, comprising:

a support member;

a pivot arm pivotally connected to said support member;

sensor means for sensing a movement of said pivot arm when said sensor means is coupled to said pivot arm, said sensor means including:

displacement measurement means, connected to said support member, for generating a signal in response to a sensed movement of said pivot arm; and connecting means for releasably connecting said pivot arm to said displacement measurement means; and actuating means, connected to said support member, for actuating said connecting means to connect said pivot arm to said displacement measurement means.

14. A tool as defined in claim 13, wherein said connecting means includes:

a connector strap extending from said pivot arm; and clamp means for clamping said strap to said displacement measurement means in response to said actuating means.

15. A tool as defined in claim 14, wherein:

said tool further comprises drive means for pivoting said pivot arm relative to said support member; and said actuating means includes clamp movement means, responsive to said drive means, for moving said clamp means from an engagement position, wherein said strap is clamped to said displacement measurement means, to a disengagement position, wherein said strap is unclamped from said displacement measurement means.

16. A tool as defined in claim 15, wherein:

said displacement measurement means includes a linearly variable differential transformer transducer having a body connected to said support member and having a movable member slidably disposed for longitudinal movement within said body;

said strap has a first end and a second end, said first end extending transversely to said support member and connected to said pivot arm;

said connecting means further includes:

a guide shoe connected to said support member, said guide shoe having a curved edge along which said strap extends so that said second end of said strap extends transversely to said first end of said strap; and means for connecting said second end of said strap to said drive means; and said clamp means includes:

an elbow member having a first arm section and a second arm section connected in transverse relationship to each other, said first arm section having an engagement surface and having a clamp member biased towards said engagement surface but responsive to said clamp movement means, said strap disposed between said engagement surface and said clamp member so that said clamp member holds said strap against said engagement surface when said clamp movement means releases said clamp member for movement to said engagement position and so that said clamp member releases said strap when said clamp movement means holds said clamp member in said disengagement position, and said second arm section connected to said movable member of said transducer; and means for pivotably connecting said elbow member to said support member.

17. A tool as defined in claim 15, further comprising means, connected to said support member, for generating a signal corresponding to the force exerted by said drive means on said pivot arm.

18. A tool as defined in claim 13, further comprising means, connected to said support member, for generating a signal corresponding to the total radial movement of said pivot arm.

19. A well bore measurement tool, comprising:

a support member;

a plurality of pivot arms, each of said arms including a first section having a first end pivotally connected to said support member and having a second end, and each of said arms further including a second section having a first end pivotally connected to said second end of said first section and having a second end;

drive means, connected to said support member and connected to said second ends of said second sections of said pivot arms, for commonly moving said pivot arms so that said second ends of said first sections and said firstends of said second sections are simultaneously moved outwardly from said support member and for exerting independent forces on said pivot arms, said drive means including a carriage; a plurality of spring guide rods slidably disposed in said carriage, each of said rods connected to the second end of the second section of a respective one of said pivot arms; a plurality of springs, each of said springs mounted on a respective one of said rods; and means, connected to said support member and said carriage, for moving said carriage relative to said support member;

a plurality of sensor means for sensing movements of said pivot arms, each or said sensor means associated with a respective one of said pivot arms and each including transducer means, connected to said support member, for converting a sensed movement of the respective one of said pivot arms into a corresponding electrical signal; a coupling line extending from the respective one of said pivot arms; and engagement means for engaging said coupling line with said transducer means when said engagement means is in an engagement position and for disengaging said coupling line from said transducer means when said engagement means is in a disengagement position; and means, responsive to movement of said carriage, for moving said engagement means between said engagement and disengagement positions.

20. A tool as defined in claim 19, wherein:

said carriage has longitudinally spaced first and second ends, said first end of said carriage disposed nearer than said second end of said carriage to said pivot arms and said and second ends of said carriage having longitudinally aligned apertures defined therethrough, each pair of said aligned apertures slidingly receiving a respective one of said rods; and said drive means further includes:

seal means, disposed in each of said apertures, for providing balanced pressure seals between said carriage and said rods; and a plurality of retaining collars, each of said collars disposed on a respective one of said rods between said first and second ends of said carriage so that the respective one of said springs mounted on the respective one of said rods extends between the respective one of said collars and said second end of said carriage.

21. A tool as defined in claim 20, wherein said means for moving said carriage within said housing includes a single electric motor; and coupling means for coupling said motor to said carriage.

22. A tool as defined in claim 19, wherein said means for moving said carriage within said housing includes:

a single electric motor; and coupling means for coupling said motor to said carriage.

23. A tool as defined in claim 19, further comprising sensor means, connected to said support member, for generating respective electrical signals corresponding to the forces exerted by each of said plurality of springs.

24. A well bore measurement tool, comprising:

a support member;

a plurality of pivot arms, each of said arms including a first section having a first end pivotally connected to said support member and having a second end, and each of said arms further including a second section having a first end pivotally connected to said second end of said first section and having a second end;

drive means, connected to said support member and connected to said second ends of said second sections of said pivot arms, for commonly moving said pivot arms so that said second ends of said first sections and said first ends of said second sections are simultaneously moved outwardly from said support member and for exerting independent forces on said pivot arms, said drive means including: a carriage; a plurality of spring guide rods slidably disposed in said carriage, each of said rods connected to the second end of the second section of a respective one of said pivot arms; a plurality of springs, each of said springs mounted on a respective one of said rods; and means, connected to said support member and said carriage, for moving said carriage relative to said support member; and sensor means, connected to said support member, for generating respective electrical signals corresponding to the forces exerted by each of said plurality of springs.

25. A tool as defined in claim 24, wherein:

said carriage has longitudinally spaced first and second ends, said first end of said carriage disposed nearer than said second end of said carriage to said pivot arms and said first and second ends of said carriage having longitudinally aligned apertures defined therethrough, each pair of said aligned apertures slidingly receiving a respective one of said rods; and said drive means further includes: seal means, disposed in each of said apertures, for providing balanced pressure seals between said carriage and said rods; and a plurality of retaining collars, each of said collars disposed on a respective one of said rods between said first and second ends of said carriage so that the respective one of said springs mounted on the respective one of said rods extends between the respective one of said collars and said second end of said carriage.

26. A tool as defined in claim 25, wherein said means for moving said carriage within said housing includes a single electric motor; and coupling means for coupling said motor to said carriage.

27. A tool as defined in claim 24, wherein said means for moving said carriage within said housing includes:

a single electric motor; and coupling means for coupling said motor to said carriage.

28. A tool as defined in claim 24, further comprising:

a plurality of sensor means for sensing movements of said pivot arms, each of said sensor means associated with a respective one of said pivot arms and each including:

transducer means, connected to said support member, for converting a sensed movement of the respective one of said pivot arms into a corresponding electrical signal;

a coupling line extending from the respective one of said pivot arms; and engagement means for engaging said coupling line with said transducer means when said engagement means is in an engagement position and for disengaging said coupling line from said transducer means when said engagement means, is in a disengagement position; and means, responsive to movement of said carriage, for moving said engagement means between said engagement and disengagement positions.

* * * * *